US011453226B2

(12) United States Patent
Kushima

(10) Patent No.: US 11,453,226 B2
(45) Date of Patent: Sep. 27, 2022

(54) LIQUID EJECTING HEAD AND RECORDING DEVICE

(71) Applicant: KYOCERA Corporation, Kyoto (JP)

(72) Inventor: Yuka Kushima, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/651,210

(22) PCT Filed: Sep. 28, 2018

(86) PCT No.: PCT/JP2018/036240
§ 371 (c)(1),
(2) Date: Mar. 26, 2020

(87) PCT Pub. No.: WO2019/065959
PCT Pub. Date: Apr. 4, 2019

(65) Prior Publication Data

US 2020/0290356 A1 Sep. 17, 2020

(30) Foreign Application Priority Data

Sep. 29, 2017 (JP) ..... JP2017-191861

(51) Int. Cl.
*B41J 2/045* (2006.01)
*B41J 11/00* (2006.01)
(Continued)

(52) U.S. Cl.
CPC ..... *B41J 11/00216* (2021.01); *B41J 2/04553* (2013.01); *B41J 2/04586* (2013.01);
(Continued)

(58) Field of Classification Search
CPC ..... B41J 2/15; B41J 2/04553; B41J 2/04586; B41J 11/002; B41J 2/14032; B41J 2/1408;
(Continued)

(56) References Cited

U.S. PATENT DOCUMENTS 6,209,203 B1 * 4/2001 Murthy ..... B41J 2/1404 29/890.1
2006/0012622 A1 * 1/2006 Kusunoki ..... B41J 2/145 347/12
(Continued)

FOREIGN PATENT DOCUMENTS

JP 2007-030242 A 2/2007
JP 2009-241441 A 10/2009
(Continued)

*Primary Examiner* — Jason S Uhlenhake
(74) *Attorney, Agent, or Firm* — Volpe Koenig

(57) ABSTRACT

An ejection surface extends in a first direction as a scanning direction and a second direction orthogonal to the first direction and is externally exposed. A plurality of nozzles opens at the ejection surface. A plurality of partial channels is located inside the ejection surface, and at bottom surfaces on a side of the ejection surface, the nozzles open. The plurality of nozzles is arranged in a direction intersecting with the first direction in plural rows to constitute a plurality of nozzle rows. The number of the nozzles arranged in each row is greater than the number of the plural rows. Between the nozzles in each nozzle row, the nozzles in other nozzle rows appear as seen in the first direction. A position of openings in the bottom surfaces of the partial channels differs across at least some of the nozzles in each nozzle row.

20 Claims, 9 Drawing Sheets

(51) Int. Cl.
*B41J 2/15* (2006.01)
*B41M 7/00* (2006.01)

(52) U.S. Cl.
CPC ..... *B41J 2/15* (2013.01); *B41J 11/002* (2013.01); *B41J 11/0022* (2021.01); *B41J 11/00214* (2021.01); *B41M 7/0018* (2013.01)

(58) Field of Classification Search
CPC ... B41J 2/14129; B41J 2/14201; B41J 2/1433
See application file for complete search history.

(56) References Cited

U.S. PATENT DOCUMENTS

| | | | | |
|---|---|---|---|---|
| 2008/0174633 | A1* | 7/2008 | Saito | B41J 2/155<br>347/42 |
| 2010/0245508 | A1 | 9/2010 | Ikeda et al. | |
| 2012/0327149 | A1* | 12/2012 | Mochizuki | B41J 2/04596<br>347/10 |
| 2016/0279938 | A1 | 9/2016 | Takino et al. | |

FOREIGN PATENT DOCUMENTS

| | | | | |
|---|---|---|---|---|
| JP | 2010-194857 | A | | 9/2010 |
| JP | 2010194857 | A | * | 9/2010 |
| JP | 2012-139980 | A | | 7/2012 |
| JP | 2015-044408 | A | | 3/2015 |
| JP | 2016-182811 | A | | 10/2016 |

* cited by examiner

LIQUID EJECTING HEAD AND RECORDING DEVICE

TECHNICAL FIELD

The present invention relates to a liquid ejecting head and a recording device.

BACKGROUND ART

A known liquid ejecting head ejects liquid (ink, for example) from plural nozzles onto a recording medium (paper, for example) for printing (PTL 1, for example). Typically, the plural nozzles are arranged in a direction that intersects with the direction of relative movement between the liquid ejecting head and the recording medium (hereinafter, referred to as a first scanning direction), constituting a nozzle row. During relatively moving the liquid ejecting head and the recording medium, the nozzle row repeatedly ejects liquid to form a two-dimensional image. The liquid ejecting head sometimes includes plural nozzle rows. In such a case, the plural nozzles in the plural nozzle rows are designed not to overlap each other in a direction (hereinafter, referred to as a second scanning direction) orthogonal to the first scanning direction. This can increase the density of dots in the second scanning direction on the recording medium.

A liquid ejecting head like that described above includes an individual channel including: a pressure chamber; a partial channel extending from the pressure chamber toward the recording medium; and a nozzle opening at the bottom surface (the surface on the side of the recording medium) of the partial channel. The individual channel is filled with ink. Applying pressure to the pressure chamber causes liquid to be ejected from the nozzle. PTL 1 discloses a technique to create variation in position of the openings of the nozzles relative to the respective bottom surfaces of the partial channels across the nozzle rows. To be more specific, the position of the openings of the nozzles in the respective bottom surfaces of the partial channels varies across plural nozzle rows in the second scanning direction (the direction that the nozzle rows extend). In PTL 1, the openings of the plural nozzles in each nozzle row are located at identical positions in the respective bottom surfaces of the partial channels.

CITATION LIST

Patent Literature

PTL 1: Japanese Unexamined Patent Application Publication No. 2007-30242

SUMMARY OF INVENTION

A liquid ejecting head according to an aspect of the disclosure includes an ejection surface, a plurality of nozzles, and a plurality of partial channels. The ejection surface extends in a first direction as a scanning direction and a second direction orthogonal to the first direction and is externally exposed. The plurality of nozzles opens at the ejection surface. The plurality of partial channels is located inside the ejection surface. The nozzles open at the bottom surfaces on a side of the ejection surface. The plurality of nozzles is arranged in plural rows in a direction intersecting with the first direction to constitute a plurality of nozzle rows. The number of the nozzles arranged in each row is greater than the number of the plural rows. Between the nozzles in each nozzle row, the nozzles in other nozzle rows appear as seen in the first direction. A position of openings in the bottom surfaces of the partial channels differs across at least some of the nozzles in each nozzle row.

A recording device according to an aspect of the disclosure includes: the aforementioned liquid ejection head; and a driving section allowing relative movement between the liquid ejecting head and the recording medium in the first direction.

DESCRIPTION OF EMBODIMENTS

Hereinafter, an embodiment of the disclosure is described with reference to the drawings. The drawings used in the following description are schematic, and not necessarily drawn to scale. The dimensional proportions and the like of the same component illustrated in plural drawings are not the same to exaggerate the shape or the like.

Some of the drawings include an orthogonal coordinate system of D1-axis, D2-axis, D3-axis, and the like for convenience. The liquid ejecting head can be used with any side up or down. Terms, such as "the lower surface", are sometimes used with the positive side on the D3 axis being upper for convenience.

(Entire Configuration of Printer)

Figure 1A:
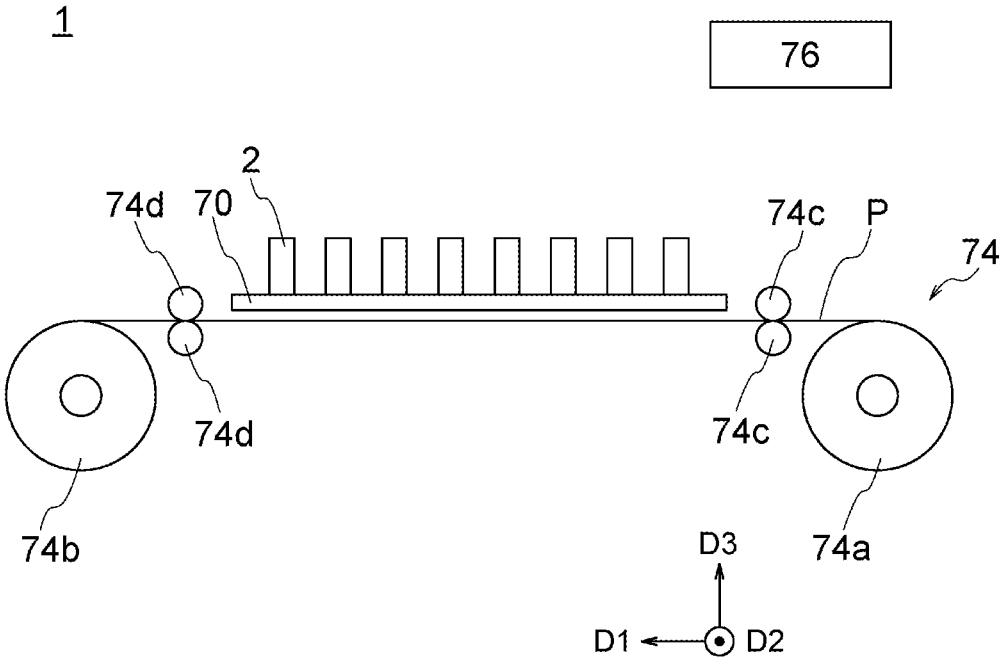
FIG. 1A is a side view schematically illustrating a recording device including liquid ejecting heads according to an embodiment.
Figure 1B:
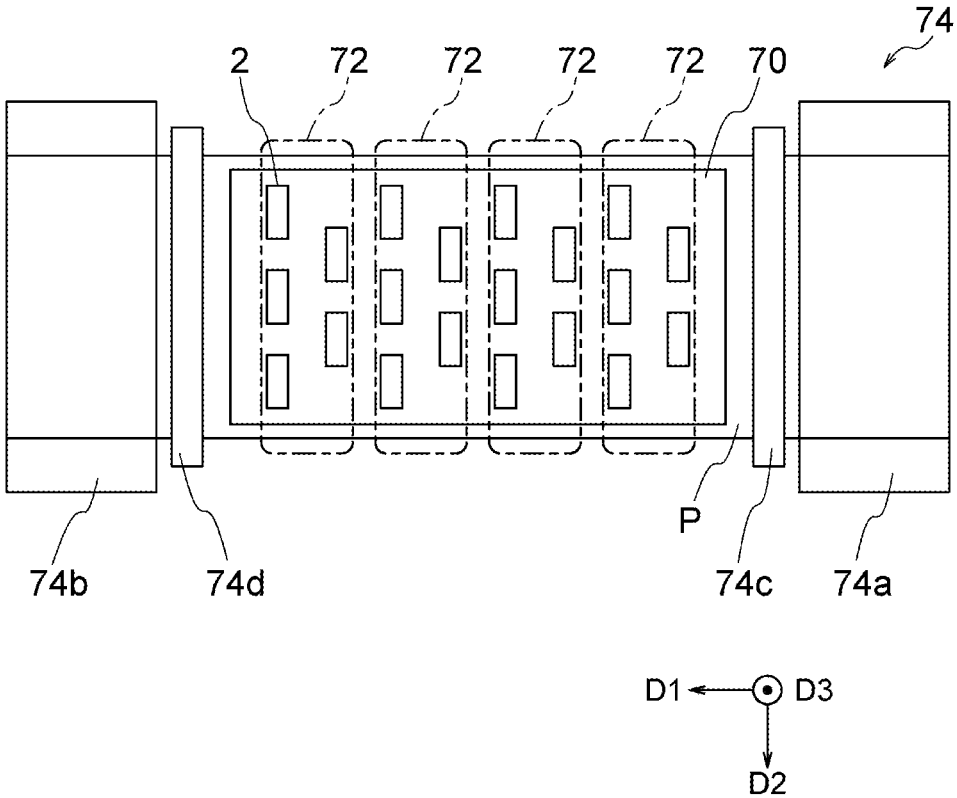
FIG. 1B is a plan view schematically illustrating the recording device including the liquid ejecting heads according to the embodiment.

FIG. 1A is a side view illustrating the configuration of a main part of a printer 1 according to the embodiment, and FIG. 1B is a top view of the printer 1.

In the description of the embodiment, the printer 1 is a so-called line-type ink-jet color printer by way of example. The printer 1 includes: heads 2 ejecting ink (liquid); a driving section 74 that causes relative movement between the heads 2 and a recording medium P; and a controller 76 controlling the heads 2 and the driving section 74. In the printer 1, the driving section 74 allows relative movement between the heads 2 and the recording medium P in the D1 direction with the recording medium P and heads 2 facing each other in the D3 direction. During the relative movement described above, the printer 1 allows the heads 2 to eject ink droplets onto the recording medium P, at plural positions in the D2 direction, thus forming a certain two-dimensional image.

A flat head-mounting frame 70 is fixed to the printer 1 and is substantially parallel to the recording medium P, for example. The head mounting frame 70 includes 20 holes (not illustrated). The heads 2 include 20 heads 2 mounted in the respective holes. Five of the heads 2 constitute a head group 72, and the printer 1 includes four head groups 72.

Each head 2 is elongated in the direction (in the D2 direction) orthogonal to the conveyance direction of the recording medium P. In each head group 72, three of the five heads 2 are aligned in a direction intersecting with the conveyance direction of the recording medium P. The other two heads 2 are disposed at a shifted position from the three heads 2 in the conveyance direction, between the three heads 2. The heads 2 adjacent to each other are disposed so that the ranges printable by the heads 2 adjacent to each other are connected in the width direction of the recording medium P or overlap each other. The printer 1 is thereby able to print with no void in the width direction of the recording medium P.

The four head groups 72 are sequentially disposed in the conveyance direction of the recording medium P. Each head 2 is supplied with ink from a not-illustrated liquid tank. The heads 2 in the same head group 72 are supplied with ink of the same color, and ink of four colors is printed with the four head groups. The colors of ink ejected from the head groups 72 are magenta (M), yellow (Y), cyan (C), and black (K), for example.

The number of heads 2 mounted on the printer 1 may be one for one-color printing within a range printable by the single head 2. The number of heads 2 included in each head group 72 or the number of head groups 72 can be properly changed depending on the print target or print conditions. The number of head groups 72 may be increased for printing of five or more colors, for example. A plurality of head groups 72 for printing in the same color may be disposed to be used alternately in the conveyance direction for printing. This can increase the printing rate, that is, the conveyance rate. Alternatively, a plurality of head groups 72 for printing in the same color may be disposed at different positions in a direction that intersects with the conveyance direction, to increase the resolution in the width direction of the recording medium P.

In addition to printing with colored ink, the printer 1 may print liquid, such as a coating agent, for surface treatment of the recording medium P. The heads 2 may perform printing with the liquid, such as a coating agent, uniformly or in a pattern. When the recording medium is less permeable to liquid, for example, the coating agent may be an agent forming a liquid receiving layer to facilitate fixing of the liquid. When the recording medium is permeable to liquid, as another example, the coating agent may be an agent forming a liquid impermeable layer in order to prevent the liquid from running to an excessively wide range or being mixed with another liquid droplet that has landed next.

The driving section 74 conveys the recording medium P from a conveyance roller 74*a* to a conveyance roller 74*b*, for example, to move the recording medium P relatively to the liquid ejecting heads 2. The recording medium P, which is wound on the conveyance roller 74*a*, passes between two conveyance rollers 74*c* and then passes under the heads 2 mounted on the head mounting frame 70. The recording medium P then passes between two conveyance rollers 74*d* and is finally rewound on the conveyance roller 74*b*.

The controller 76 controls the heads 2 based on data of images and characters, for example, and causes the heads 2 to eject ink toward the recording medium P. The controller 76 may control individual sections of the printer 1 depending on the conditions of the individual sections of the printer 1 known based on information from sensors attached to the printer 1, such as a position sensor, a speed sensor, or a temperature sensor.

The recording medium P is not limited to printing paper and may be cloth or the like. When the printer 1 is configured to move a conveyance belt instead of the recording medium P, the recording medium may be a sheet, a piece of cloth, a piece of wood, or a tile placed on the conveyance belt, in addition to rolls of recording media. The printer 1 may print a wiring pattern of electronic devices by causing the heads 2 to eject liquid containing conductive particles. Furthermore, the printer 1 may be configured to produce chemicals by causing the heads 2 to eject a predetermined amount of liquid chemical agent or a predetermined amount of liquid containing a chemical agent, toward a reaction container for reaction or the like.

(Summary of Nozzle Arrangement)

Figure 2A:
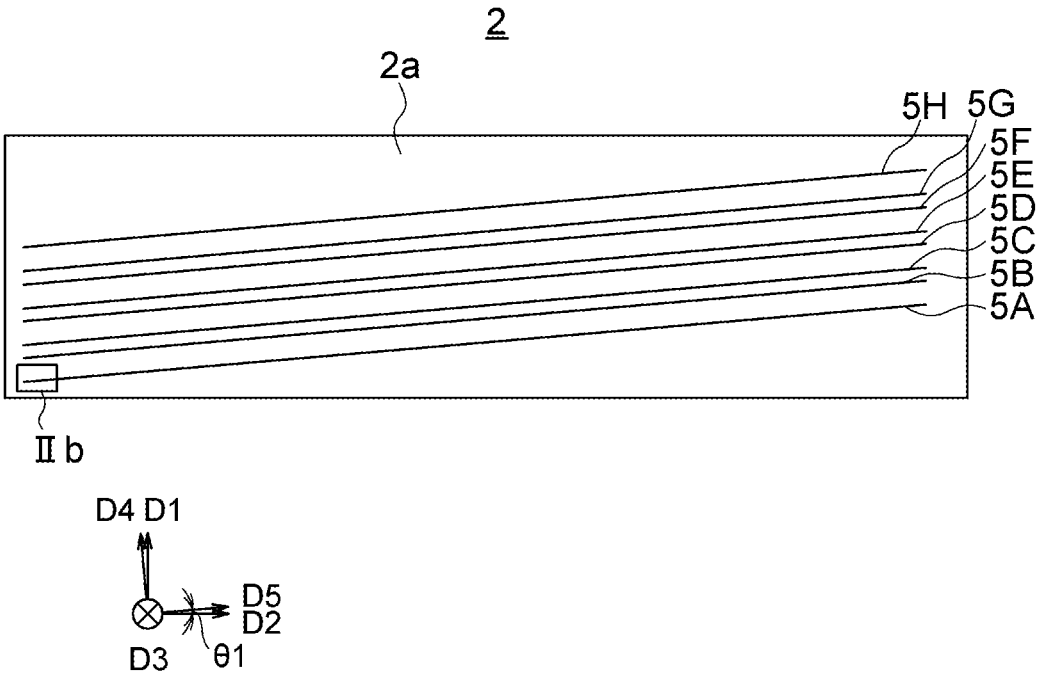
FIG. 2A is a plan view illustrating the lower surface of the liquid ejecting head according to the embodiment.
Figure 2B:
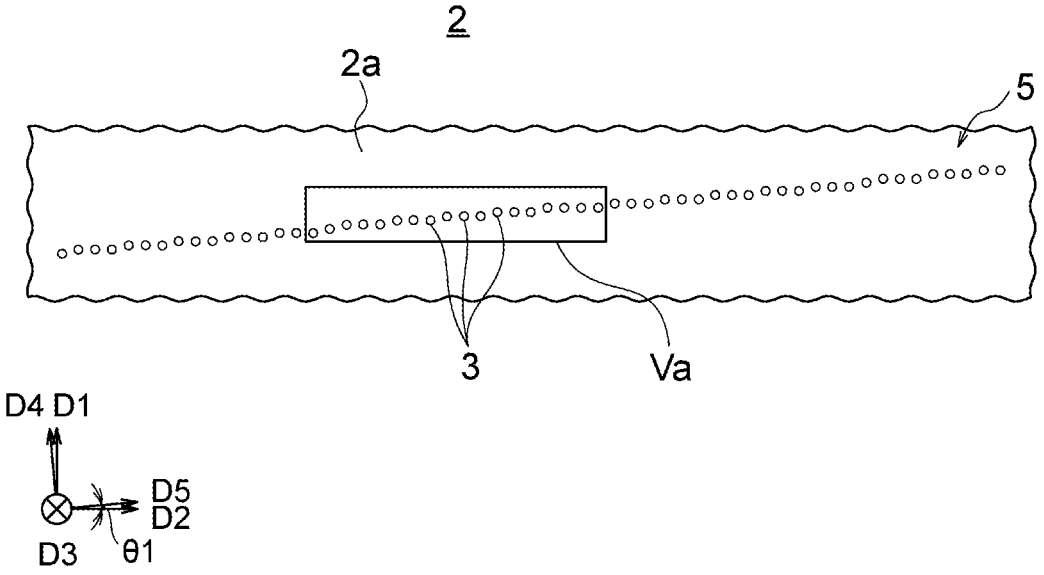
FIG. 2B is an enlarged view of a region IIb of FIG. 2A.

FIG. 2A is a plan view illustrating the lower surface (farther in the negative direction on the D3 axis) of one of the heads 2. FIG. 2B is an enlarged view of a region IIb of FIG. 2A.

The lower surface of each head 2 is located facing the recording medium P and is referred to as an ejection surface 2*a* hereinafter. In the ejection surface 2*a*, plural nozzles 3 ejecting ink droplets are arranged in plural rows (eight rows in the example of FIG. 2A). The plural nozzles 3 constitute plural nozzle rows 5A to 5H (A to H are sometimes omitted hereinafter). Each of the plural nozzles 3 corresponds to one dot on the recording medium P.

In FIG. 2A, since the nozzles 3 are fine compared to the ejection surface 2*a*, the nozzle rows 5 are represented by straight lines. In the enlarged view of FIG. 2B, the nozzles 3 are represented larger than the actual size (enlarged with respect to the pitch). In the drawings described later as well, the nozzles 3 are represented large for convenience.

The plural nozzle rows 5 are substantially parallel to each other and have equal length, for example. The nozzle rows 5 are inclined with respect to the D2 direction (which is orthogonal to the D1 direction as the direction of relative movement between the recording medium P and the heads 2). An inclination angle θ1 thereof may be properly set and is not less than three degrees and not more than ten degrees, for example. In the drawings of this embodiment, the inclination angle θ1 is about five degrees by way of example.

FIG. 2A and other drawings illustrate a D5 axis substantially parallel to the nozzle rows 5 and a D4 axis orthogonal to the D5 axis.

In the example of FIG. 2A, spaces between the plural nozzle rows 5 are not identical. The plural spaces have two alternating widths. Such a configuration is for convenience of later-described arrangement of channels within each head 2, for example. However, the plural spaces may have the same size.

Each nozzle row 5 includes a comparatively large number of nozzles 3. The number of nozzles 3 in each nozzle row 5 is greater than at least the number of nozzle rows 5 (the number of rows), for example. The number of nozzles 3 in each nozzle row 5 may be set properly and is not less than 700 and not more than 1000, for example. The pitch of the plural nozzles 3 is substantially consistent in the D2 direction. The pitch of the plural nozzles 3 in each nozzle row 5 is substantially identical across the plural nozzle rows 5.

Figure 3:
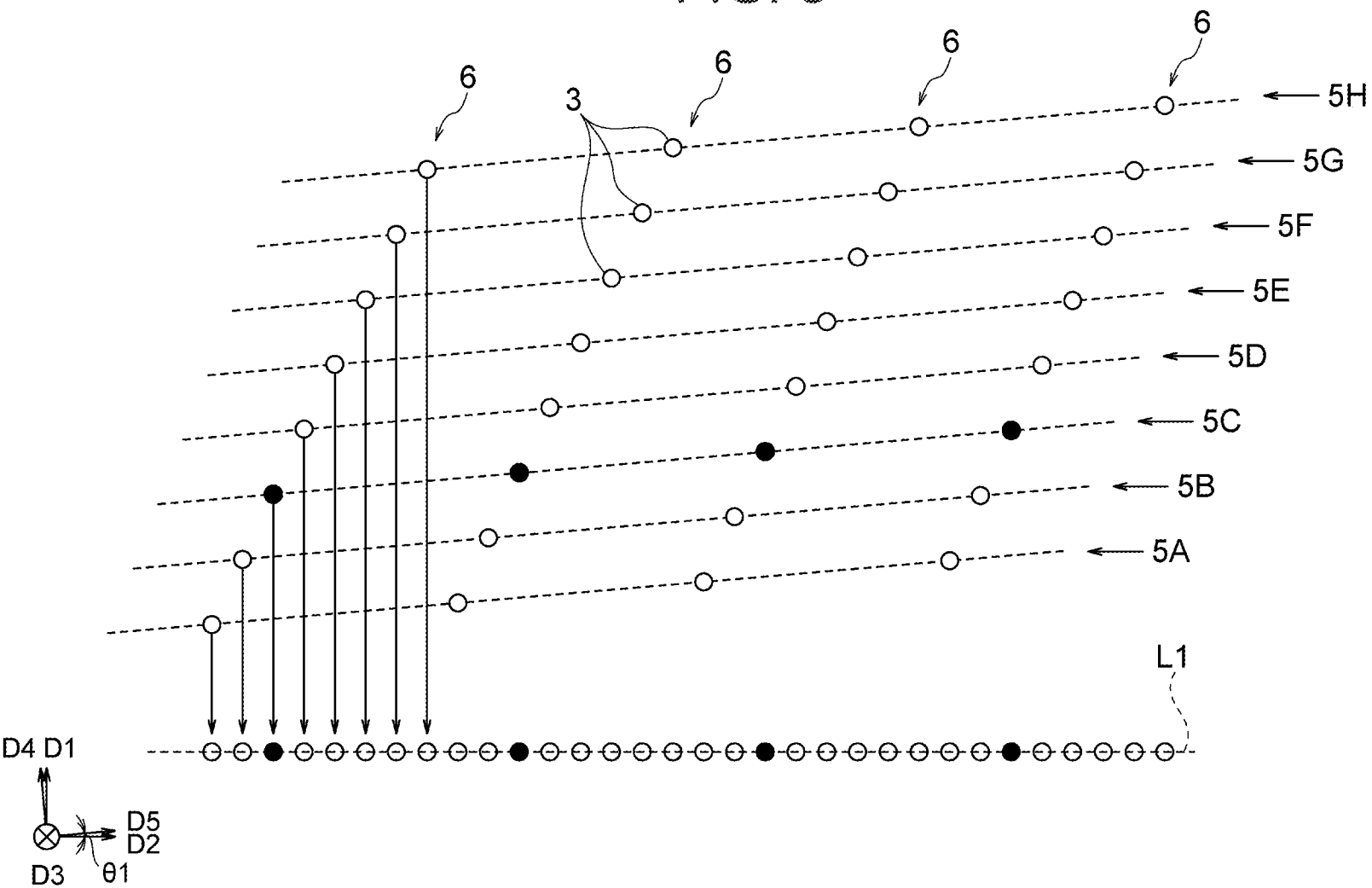
FIG. 3 is a schematic diagram for explaining the summary of the positional relationship between plural nozzle rows according to the embodiment.

FIG. 3 is a schematic diagram for explaining the summary of the positional relationship of nozzles between the plural nozzle rows 5. The nozzles 3 in the nozzle row 5C are represented by black circles unlike the other nozzles 3. This is for easy explanation of effects (described later), and being represented by black circles can be ignored.

The plural nozzle rows 5 include the plural nozzles 3 so that when the plural nozzles 3 are projected as indicated by arrows, in the D1 direction (in the direction of relative movement between the head 2 and the recording medium P) onto a line L1 parallel to the D2 direction, the nozzles 3 of each nozzle row 5 appear in turn sequentially in an order. The order is previously determined for the plural nozzle rows 5. The pitch in the D2 direction, of the plural nozzles projected on the line L1 is substantially consistent.

As understood from the above description, when the head 2 includes n nozzle rows 5, the density of dots on the line L1 is n times the density of dots of each nozzle row 5. The density of dots may be set properly. As an example, when the density of dots in each nozzle row 5 in the D2 direction is not less than 100 dpi and not greater than 200 dpi, the density of dots in the D2 direction implemented by eight nozzle rows 5 is not less than 800 dpi and not greater than 1600 dpi.

In the example of FIG. 3, the nozzles 3 of the plural nozzle rows 5 appear on the line L1 in the same order as the plural nozzle rows 5 are disposed in the D1 direction for convenience of explanation. From another viewpoint, plural nozzles 3 constitute nozzle columns 6 extending in a substantially linear manner in the direction intersecting with the D5 axis. The orders of the nozzle rows 5 and nozzle columns 6 may be different from each other. From still another viewpoint, the linear nozzle columns 6 may not be disposed.

(Summary of Head Structure)

Figure 4:
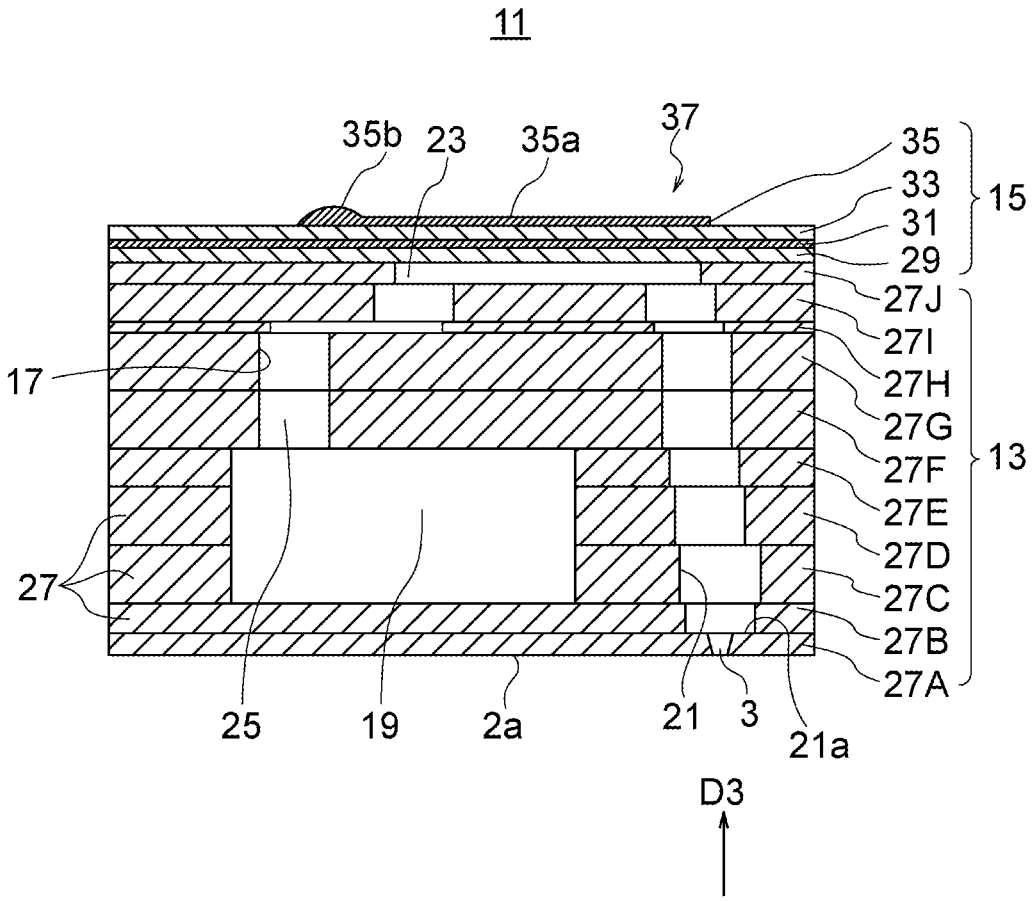
FIG. 4 is a schematic enlarged sectional view illustrating a part of the liquid ejecting head according to the embodiment.

FIG. 4 is an enlarged sectional view schematically illustrating a part of the head 2. The lower side in the page of FIG. 2 corresponds to the side of the head 2 facing the recording medium P (the −D3 side).

The head 2 is a piezo-electric head which applies pressure to ink through mechanical strain of a piezoelectric element. The head 2 includes plural ejection elements 11 for the respective nozzles 3. FIG. 4 illustrates one of the ejection elements 11.

The plural ejection elements 11, not illustrated particularly, substantially constitute one row for each nozzle row 5, for example. The orientation and the number of ejection elements 11 in each row are properly determined together with the design of the path of a common channel 19 described later. For example, the ejection elements 11 in each row may include identical orientations or may include orientations alternately reversed. Each row of ejection elements 11 may be disposed for one of the nozzle rows 5. Alternatively, two rows of ejection elements 11 may be disposed across each nozzle row 5 in the reversed manner to each other. In two rows of ejection elements 11 corresponding to two nozzle rows 5 adjacent to each other, the ejection elements 11 in one row and the ejection elements 11 in the other row are alternately arranged to apparently form one row.

From another aspect, the head 2 includes a channel member 13 forming a space to reserve ink and an actuator 15 applying pressure to the ink reserved in the channel member 13. The plural ejection elements 11 are composed of the channel member 13 and actuator 15.

(Configuration of Channel Member)

Within the channel member 13, a plurality of individual channels 17 (one of the individual channels 17 is illustrated in FIG. 4) and the common channel 19 communicating with the plurality of individual channels 17 are formed. The individual channels 17 are provided for respective ejection elements 11 while the common channel 19 is shared by the plurality of ejection elements 11.

Each individual channel 17 includes one of the nozzles 3 described above, a partial channel 21, a pressure chamber 23, and a supply path 25. The nozzle 3 opens at a bottom surface 21*a* of the partial channel 21. The pressure chamber 23 communicates with the partial channel 21. The supply path 25 allows communication between the pressure chamber 23 and common channel 19.

The plural individual channels 17 and common channel 19 are filled with ink. When the pressure chamber 23 changes in capacity and applies pressure to the ink, the ink is fed from the pressure chamber 23 to the partial channel 21, so that the nozzle 3 ejects an ink droplet. The pressure chamber 23 is refilled with ink from the common channel 19 through the supply path 25.

The sectional shapes or planar shapes of the plural individual channels 17 and common channel 19 may be determined properly. For example, the pressure chamber 23 has a certain thickness in the D3 direction and is substantially rhombic or elliptic in a plan view (not illustrated). An end of the pressure chamber 23 in a planar direction communicates with the partial channel 21, and an end on the opposite side communicates with the supply path 25. A part of the supply path 25 forms a throttle having a smaller cross-section orthogonal to the direction of flow than that of the common channel 19 and pressure chamber 23.

The partial channel 21 extends from the bottom surface (the −D3 side surface) of the pressure chamber 23 toward the ejection surface 2*a*. The shape of the cross section (orthogonal to the D3 axis) of the partial channel 21 may be properly determined and is rectangular (see FIG. 5B) in this embodiment. The sectional shape (including dimensions) of the partial channel 21 may be uniform or may be varied over the length (substantially in the D3 direction). In the example illustrated in FIG. 4, the sectional shape of the partial channel 21 is varied slightly. The partial channel 21 may extend in parallel to the D3 axis or extend with a proper inclination to the D3 axis.

The shape of the nozzles 3 may be determined properly. For example, each nozzle 3 is circular in a plan view and tapers toward the ejection surface 2*a*. The nozzle 3 therefore has a substantially truncated cone shape. The opening area of the nozzle 3 in the bottom surface 21*a* is obviously smaller than the bottom surface 21*a*.

As described above, the ejection elements 11 may be arranged in one or two rows for each nozzle row 5, for example. The ejection elements 11 corresponding to two adjacent nozzle rows 5 may be apparently arranged in a single row. The bottom surfaces 21*a* of the partial channels 21 are sections where the respective nozzles 3 open. The arrangement of the bottom surfaces 21*a* is therefore substantially the same as that of the nozzles 3. Specifically, the plural bottom surfaces 21*a* constitute the same number of bottom surface rows 22 as the number of nozzle rows 5 (see FIG. 5A), the bottom surface rows 22 extending substantially along the nozzle rows 5.

The plural individual channels 17 include substantially identical configurations (except the orientations in a plan view). The configurations of the plural individual channels 17 may be partially different from each other in inclinations of the partial channels 21 and the like. However, the bottom surfaces 21*a* of the partial channels 21 and the nozzles 3 have identical shapes across the plural individual channels 17, for example.

The common channel 19 extends below the pressure chamber 23 along the ejection surface 2*a*, for example. The common channel 19 includes branches in a manifold manner (not illustrated), for example. The branches extend along the nozzle rows 5, for example. In the configuration including the nozzle columns 6, the aforementioned branches may be extended along the nozzle columns 6 instead of the nozzle rows 5.

The channel member 13 includes plural substrates 27A to 27J (A to J are sometimes omitted hereinafter) stacked on top of each other, for example. In the substrates 27, a through hole is disposed, that constitutes the plural individual channels 17 and common channel 19. The thicknesses and the number of the plural substrates 27 may be properly determined depending on the shapes of the plural individual channels 17 and common channel 19 or the like. Each of the plural substrates 27 may be made of a proper material, such as metal, resin, ceramic, or silicon, for example.

The farthest substrate 27 in the −D3 direction among the plural substrates 27, is sometimes referred to as a nozzle plate 27A. For example, the lower surface of the nozzle plate 27A constitutes the ejection surface 2*a* while the upper surface thereof constitutes the bottom surfaces 21*a* of the partial channels 21. Each nozzle 3 is composed of a hole penetrating the nozzle plate 27A in the thickness direction.

(Configuration of Actuator)

The actuator 15 is a unimorph piezoelectric element that is displaced in bend mode, for example. Specifically, the actuator 15 includes a vibration plate 29, a common electrode 31, a piezoelectric material 33, and plural individual electrodes 35, which are stacked in this order from the pressure chamber 23 side, for example.

The vibration plate 29, common electrode 31, and piezoelectric material 33 are common to the plural pressure chambers 23 (the plural ejection elements 11) so as to cover the plural pressure chambers 23, for example. On the other hand, the individual electrodes 35 are disposed for the respective pressure chambers 23 (the ejection elements 11). Herein, a section of the actuator 15 corresponding to one ejection element 11 is sometimes referred to as a pressurization element 37. The plural pressurization elements 37 include identical configurations (except the orientations in a plan view).

The vibration plate 29 is laid on the upper surface of the channel member 13 to close the opening in the upper surface of the pressure chamber 23, for example. The opening in the upper surface of the pressure chamber 23 may be closed by the substrate 27, on which the vibration plate 29 is laid. In this case, the substrate 27 may be considered as a part of the vibration plate, and the pressure chamber 23 may be considered to be closed by the vibration plate.

In the piezoelectric material 33, the direction of polarization is set to the thickness direction (in the D3 direction). When voltage is applied to the common electrode 31 and individual electrodes 35 to cause the electric field to act on the piezoelectric material 33 in the direction of polarization, for example, the piezoelectric material 33 contracts in a plane (a plane orthogonal to the D3 axis). Because of this contraction, the vibration plate 29 bends to be convex toward the pressure chamber 23, and the pressure chamber 23 thereby changes in capacity.

The common electrode 31 covers the plural pressure chambers 23 as described above and is given a certain electric potential (reference potential, for example). Each individual electrode 35 includes an individual electrode body 35*a* located above the pressure chamber 23 and a lead electrode 35*b* led from the individual electrode body 35*a*. The individual electrode bodies 35*a* include substantially the same shape and size as the pressure chamber 23 in a plan view, (not illustrated). By individually applying the electric potential (driving signal) to the plural individual electrodes 35, ejection of ink droplets from the plural nozzles 3 is individually controlled.

Each of the vibration plate 29, common electrode 31, piezoelectric material 33, and individual electrodes 35 is made of a proper material. The vibration plate 29 may be made of ceramic, silicon oxide, or silicon nitride, for example. The common electrode 31 and individual electrodes 35 are made of platinum or palladium, for example. The piezoelectric material 33 is made of ceramic, such as lead zirconate titanate (PZT), for example.

The actuator 15 is connected to a flexible printed circuit board (FPC) that is located above the actuator 15 and faces the actuator 15 (not illustrated). Specifically, the FPC is connected to the lead electrodes 35*b* and is connected to the common electrode 31 through a not-illustrated via conductor and the like. For example, the controller 76 applies a certain electric potential to the common electrode 31 through a not-illustrated driving IC mounted on the FPC and individually inputs driving signals to the plural individual electrodes 35.

(Variation in Nozzle Position in Nozzle Row)

Figure 5A:
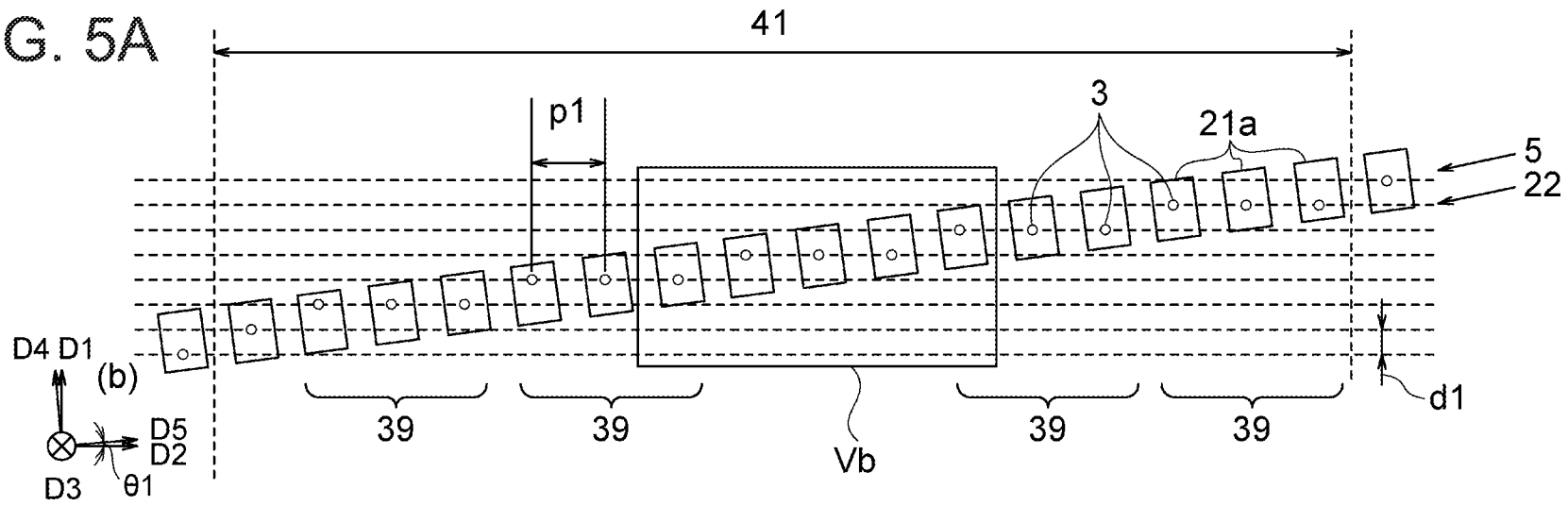
FIG. 5A is an enlarged transparent diagram of a region Va of FIG. 2B.
Figure 5B:
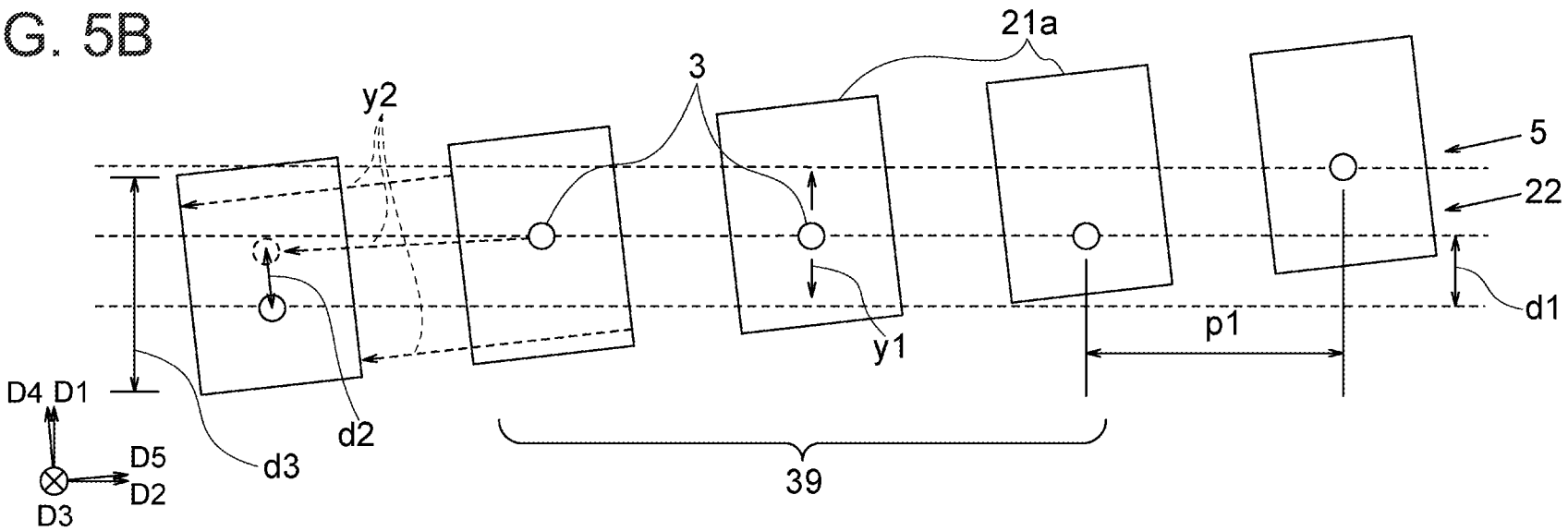
FIG. 5B is an enlarged view of a region Vb of FIG. 5A.

FIG. 5A is an enlarged transparent view of a region Va of FIG. 2B. FIG. 5B is an enlarged view of a region Vb of FIG. 5A. FIGS. 5A and 5B illustrate the bottom surfaces 21*a* of the partial channels 21 in addition to the nozzles 3. These drawings also illustrate plural dot lines parallel to the D2 axis. The pitch (a displacement d1) of the plural dotted lines is consistent.

As described above, in a plan view of the ejection surface 2*a*, the arrangement of the plural nozzles 3 is substantially the same as the arrangement of the bottom surfaces 21*a* of the plural partial channels 21. To be more specific, however, those arrangements are different from each other. In each nozzle row 5, at least some of the nozzles 3 have openings at different positions in the respective bottom surfaces 21*a* (at different relative positions to the bottom surfaces 21*a*). This can provide various effects (described later). The details thereof are as follows.

In each bottom surface row 22, the plural bottom surfaces 21*a* are linearly arranged with a consistent pitch in the D5 direction with identical orientations. On the other hand, in each nozzle row 5, the plural nozzles 3 are arranged with a consistent pitch p1 in the D2 direction but not linearly arranged (the variation in position of plural nozzles 3 in the D1 direction is not constant with respect to the variation in position in the D2 direction). In each nozzle row 5, therefore, at least some of the nozzles 3 open at different positions in the bottom surfaces 21*a* at least in the D1 direction.

To be more specific, for example, in each nozzle row 5, the plural nozzles 3 (at least some of the nozzles 3) are arranged like a staircase which inclines in the same direction as the incline of the bottom surface row 22 to the D2 direction (each nozzle 3 located farther in the +D2 direction is also located farther in the +D1 direction). Each nozzle row 5 includes plural (two or more) nozzle groups 39 (corresponding to treads of the staircase) composed of two or more nozzles 3 arranged in parallel to the D2 direction. Each nozzle group 39 located farther in the +D2 direction is also located farther in the +D1 direction.

The number of nozzles 3 (corresponding to the unit run of the staircase) included in each nozzle group 39 may be identical or different across the plural nozzle groups 39. The specific value thereof may be properly determined. In the example illustrated in FIG. 5A, each of the plural nozzle groups 39 includes the same number of nozzles 3, or three nozzles 3.

The difference between the positions in the D1 direction, of each nozzle group 39 and the nozzle group 39 adjacent thereto (corresponding to the unit rise of the staircase, the displacement d1) may be identical or different across the plural nozzle groups 39. The specific value thereof may be determined properly. In the range of the example illustrated in FIG. 5A (within a nozzle set 41 described later), the aforementioned differences are identical throughout the plural nozzle groups 39.

The nozzle groups 39 may be adjacent to each other in the D2 direction as illustrated in the range illustrated in FIG. 5A (within the nozzle set 41 described later). Unlike the example illustrated in FIG. 5A, one or more nozzles 3 not constituting any nozzle group 39 may be interposed between the nozzle groups 39 in the D2 direction. The positions of the interposed one or more nozzles 3 in the D1 direction are between the positions in the D1 direction, of the nozzle groups 39 on both sides thereof. When two ore more nozzles 3 are interposed, each of the two or more nozzles 3 located farther in the +D2 direction is also located farther in the +D1 direction. The interposed two or more nozzles 3 do not need to be arranged linearly between the nozzle groups 39 on both sides. In other words, the sections corresponding to rises of the staircase may have comparatively steep slopes or gentle slopes or may be linear or not linear as seen in the D3 direction.

The differences in position between the openings of the plural nozzles 3 in the bottom surfaces 21*a* of the respective partial channels 21 may be properly determined. For example, as indicated by arrows y2 in FIG. 5B, it is assumed that any bottom surface 21*a* and the nozzle 3 thereof are translated onto any other bottom surface 21*a* and the nozzle 3 thereof, respectively, so that the two bottom surfaces 21*a* completely overlap. The distance in position between the openings of the nozzles 3 in the two bottom surfaces 21*a* (to be more specific, the distance between the centers (the centroids)) is denoted by d2. Various combinations of the bottom surfaces 21*a* are examined and searched for the largest distance d2. This largest distance d2 is not less than 25 μm and not greater than 50 μm, for example. For example, the distance d2 is not less than 0.1 times, not less than 0.2 times, or not less than 0.3 times a maximum dimension d3 of the bottom surface 21*a* in the direction of the distance d2 (in the D4 direction in the example illustrated in FIG. 5B).

The position of openings of the nozzles 3 in the bottom surfaces 21*a* may undergo a shift with respect to positions in the D2 direction by every nozzle 3 arranged in the row (the adjacent nozzles 3 may have openings at different positions in the respective bottom surfaces 21*a*). The position of openings may also undergo a shift by every second (or more) nozzles 3 in the row or non-periodically.

In the example illustrated in FIG. 5A, the bottom surface row 22 is inclined with respect to the D2 direction while the nozzle groups 39 are parallel to the D2 direction. In each nozzle group 39, therefore, the position of openings of the nozzles 3 in the respective bottom surfaces 21*a* undergoes a shift by every nozzle 3. In the example illustrated in FIG. 5A, the inclination between the nozzle groups 39 due to the displacement d1 or the like, is greater than the inclination of the bottom surface row 22. The position of openings of the nozzles 3 in the bottom surfaces 21*a* therefore also undergoes a shift between the nozzle groups 39. In the example illustrated in FIG. 5A, therefore, in each nozzle set 41 (described later), the position of openings of the nozzles 3 in the bottom surfaces 21*a* undergoes a shift by every nozzle 3 arranged in the nozzle set 41. In the embodiment, the inclination between the nozzle sets 41 is also different from the inclination of the bottom surface rows 22 as described later. In this embodiment, therefore, the position of openings of the nozzles 3 in the bottom surfaces 21*a* undergoes a shift by every nozzle 3 throughout the nozzle row 5. The above explanation will not deny that each nozzle row 5 includes some nozzles 3 open at identical positions in the bottom surfaces 21*a*.

From another viewpoint, the length in the D2 direction, between a shift in position of openings and the next shift in position of openings (the distance between the centers of the nozzles 3 undergoing those shifts) may be properly determined. For example, the distance is set to not longer than 400 μm. When the nozzle density of each nozzle row 5 is 150 dpi (the pitch of nozzles 3 is about 169 μm), for example, the position of openings undergoes a shift by every nozzle 3 or every second nozzle 3. As described above, the position of openings of the nozzles 3 in the bottom surfaces 21*a* undergoes a shift by every nozzle 3, that is, every about 169 μm in the example illustrated in FIG. 5A. From the opposite perspective to the above description, nozzles 3 open at identical positions in the bottom surfaces 21*a* may be separated properly. For example, the shortest distance therebetween may be set greater than 400 μm.

Considering based on the D1 and D2 axes, the plural (at least some) nozzles 3 in each nozzle row 5 are arranged like a staircase as described above. Based on the D4 and D5 axes, however, the plural (at least some) nozzles 3 in each nozzle row 5 are considered to be arranged in a meandering manner (in a zigzag or corrugated manner). In other words, as the position of the plural bottom surfaces 21*a* linearly arranged changes in the direction of arrangement thereof (in the D5 direction), the plural nozzles 3 vibrate in position in the direction (in the D4 direction) orthogonal to the direction of arrangement (the position of the plural nozzles 3 varies in position in both the +D4 and −D4 directions).

The number of nozzles 3 between a local peak of the meandering row (a local peak in the −D4 or +D4 direction, the turning point in the zigzag) and the next local peak may be one (the nozzles 3 at the consecutive local peaks may be adjacent to each other) or two or more or may be constant or not constant. The number of nozzles 3 between a local peak in the −D4 direction and the subsequent local peak in the +D4 direction may be identical to or different from the number of nozzles 3 between a local peak in the +D4 direction and the subsequent local peak in the −D4 direction. In the range of the example (within the nozzle set 41) illustrated in FIG. 5A, the plural nozzle groups 39, each including three nozzles 3 as described above, are located consecutively. In the +D5 direction, after a local peak in the +D4 direction appears at a nozzle 3, a local peak in the −D4 direction appears at a nozzle 3 that is the second nozzle from the nozzle 3 with the local peak in the +D4 direction, and the next nozzle 3 shows a local peak in the +D4 direction.

The bottom surfaces 21*a* of the partial channels 21 are rectangular, for example. To be more specific, each bottom surface 21*a* has a rectangular shape with short sides parallel to the D5 direction and long sides parallel to the D4 direction, for example. From another viewpoint, the rectangular shape includes four sides inclined with respect to the D1 and D2 directions. As described above, in this embodiment, the pitch of the plural nozzles 3 of each nozzle row 5 is constant in the D2 direction and not constant in the D1 direction. The variations in position of nozzles 3 in the bottom surfaces 21*a* contains a component in the direction of a diagonal of the rectangle as indicated by arrows y1 in FIG. 5B.

In the disclosure, the position of openings of nozzles 3 in the bottom surfaces 21*a* of the partial channels 21 include whether the positions are positive or negative in the D1 direction and the D2 direction (or the D4 direction and the D5 direction). For example, two rotationally-symmetric positions are different positions from each other, and two axis-symmetric positions are also different positions from each other.

(Nozzle Set)

Figure 6:
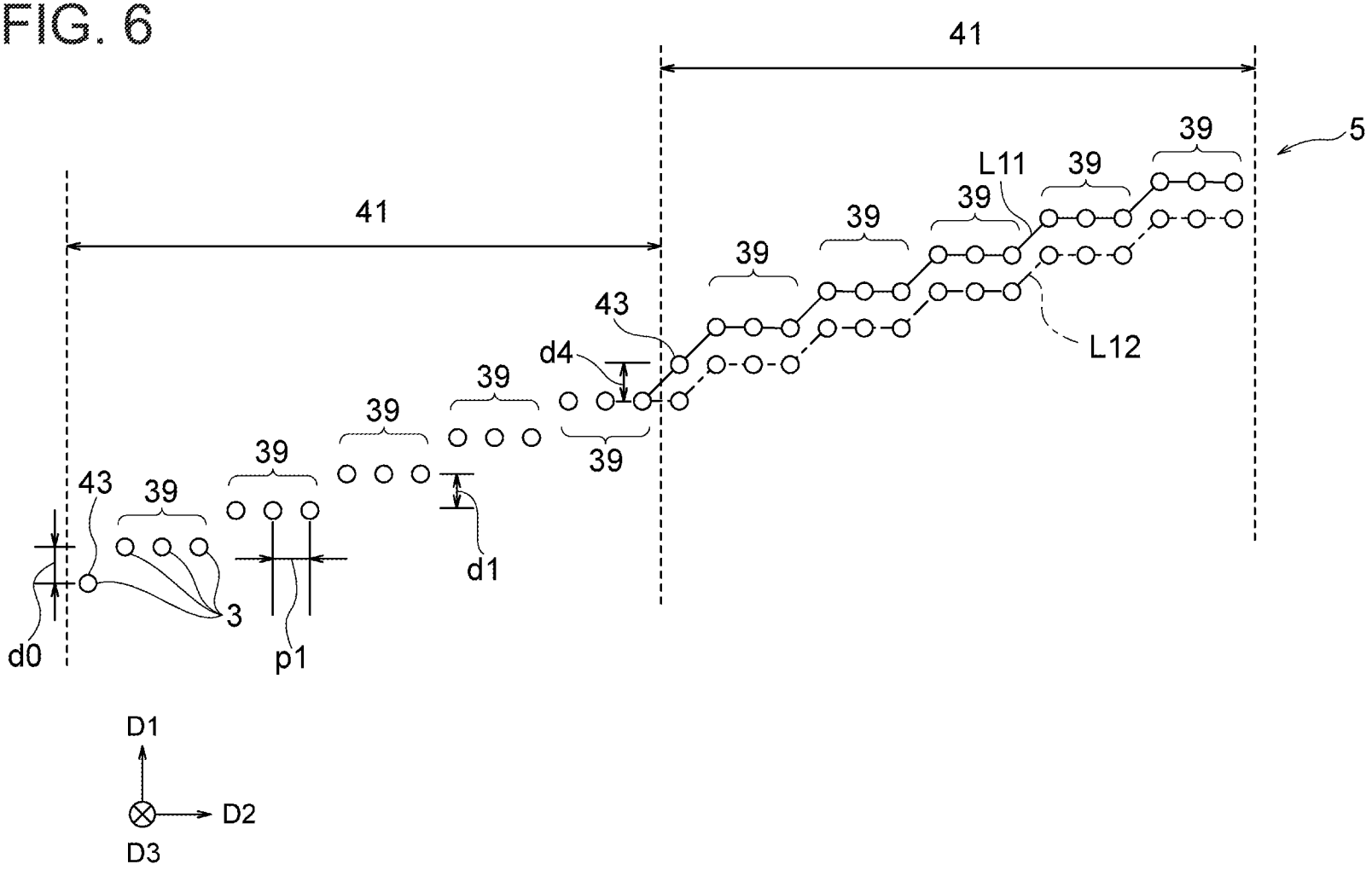
FIG. 6 is a schematic diagram illustrating nozzle rows according to the embodiment in a wider range than FIG. 5A.

FIG. 6 is a schematic diagram illustrating a nozzle row 5 in a wider range than FIG. 5A. In FIG. 6, the magnitude of the displacement d1 between the nozzle groups 39 in the D1 direction with respect to the magnitude of the pitch p1 of the nozzles 3 in the D2 direction is greater than that in FIGS. 5A and 5B for easy illustration.

The nozzle row 5 includes plural nozzle sets 41. Each nozzle set 41 includes a predetermined number of nozzles 3. The relative positions of the predetermined number of nozzles 3 in each nozzle set 41 are identical across the plural nozzle sets 41. This allows the design of the relative positions of the predetermined number of nozzles 3 to be shared by the plural nozzle sets 41, thus facilitating the designing, for example. The position of openings of the predetermined number of nozzles 3 in the bottom surfaces 21*a* within each nozzle set 41 is not always identical across the plural nozzle sets 41.

Specifically, in the example illustrated in FIG. 6, each nozzle set 41 includes a nozzle 3 as a reference point 43 and plural (five in the example illustrated) nozzle groups 39 consecutive in the D2 direction, for example. Each nozzle group 39 and the relative position thereof are as already described.

The reference point 43 is the nozzle 3 located farthest in the −D2 direction (an end of the arrangement) within each nozzle set 41, for example. The nozzle group 39 subsequent to the reference point 43 is positioned on the +D1 side of the reference point 43, for example. The difference (a displacement d0) therebetween is equal to the displacement d1 between adjacent nozzle groups 39 in the D1 direction, for example. As already described, in this embodiment, the pitch p1 of the nozzles 3 in the D2 direction is constant. The same applies to the pitch p1 between each reference point 43 and the subsequent nozzle group 39 in the D2 direction.

The position of the nozzle group 39 subsequent to the reference point 43 in the D1 direction may be on the −D1 side of the reference point 43, for example. Instead of providing the reference point 43 besides the nozzle groups 39, the nozzle 3 farthest in the −D2 direction in the nozzle group 39 located farthest in the −D2 direction may be set as the reference point. In this case, the nozzle group 39 farthest in the −D2 direction may include one more nozzle than the other nozzle groups 39 or include the same number of nozzles.

The relative position of each nozzle set 41 to the nozzle set 41 adjacent thereto may be identical across the plural nozzle sets 41 or may be different across at least some of the nozzle sets 41. This embodiment employs the latter configuration. For example, for the nozzle set 41 in the right of the page of FIG. 6, two options of nozzle set 41 are illustrated: including a nozzle set 41 with nozzles 3 connected by a line L11 and a nozzle set 41 with nozzles 3 connected by a line L12. For each nozzle set 41, the position relative to the previous nozzle set 41 (the nozzle set 41 adjacent on the −D2 side) in the D1 direction is selected from two options.

More specifically, for example, the position of the reference point 43 in the D1 direction is selected from the options of: the same position as that of the last nozzle 3 (farthest in the +D2 direction, or the nozzle 3 previous to the reference point 43 from another viewpoint) in the previous nozzle set 41; and a position on the +D1 side of the position of the aforementioned last nozzle 3. The difference (a displacement d4) therebetween is equal to the displacement d1 between the adjacent nozzle groups 39 in the D1 direction, and/or equal to the displacement d0 between each reference point 43 and the nozzle group 39 subsequent thereto in the D1 direction, for example. As already described, in the embodiment, the pitch p1 of nozzles 3 in the D2 direction is constant. The same applies to the pitch p1 between each reference point 43 and the previous nozzle 3 in the D2 direction.

In each nozzle row 5, the number of reference points 43 located on the +D1 side of the previous nozzle 3 and the number of reference points 43 located at the same position as the previous nozzle 3 in the D1 direction (the ratio of the both numbers from another viewpoint) may be properly set. The order of these options of the reference points 43 may be properly set. In this embodiment, the bottom surfaces 21*a* of the partial channels 21 are linearly arranged in the D5 direction. If each nozzle row 5 includes too many reference points 43 of one of the two options or too many consecutive reference points 43 of one of two options, the nozzles 3 cannot be accommodated within the bottom surface 21*a*, depending on the displacement d1, the number of nozzles 3 in each nozzle row 5, the inclination angle θ1, or the like. In this regard, there is a restriction on selecting between the two options of reference points.

The position of each reference point 43 to the previous nozzle 3 in the D1 direction may include two or more options (not illustrated). For example, in addition to the aforementioned two options, the options may include a position which is obtained by shifting the position of the previous nozzle 3 in the D1 direction, in the −D1 direction by the displacement d4. Instead of predetermining the options for the position of each reference point 43, the position of each reference point 43 may be properly (arbitrarily) determined.

The number of nozzles 3 included in each nozzle set 41 and the number of nozzle sets 41 included in each nozzle row 5 may be properly determined. For example, in the example illustrated in FIG. 6, each nozzle set 41 includes one reference point 43 and five nozzle groups 39 each including three nozzles 3, totally including 16 nozzles 3. Each nozzle row 5 includes a larger number of such nozzle sets 41 than the number of nozzle rows 5, or includes 10 nozzle sets 41 or more or 50 nozzle sets 41 or more, for example.

(Relationship between Plural Nozzle Rows)

Figure 7A:
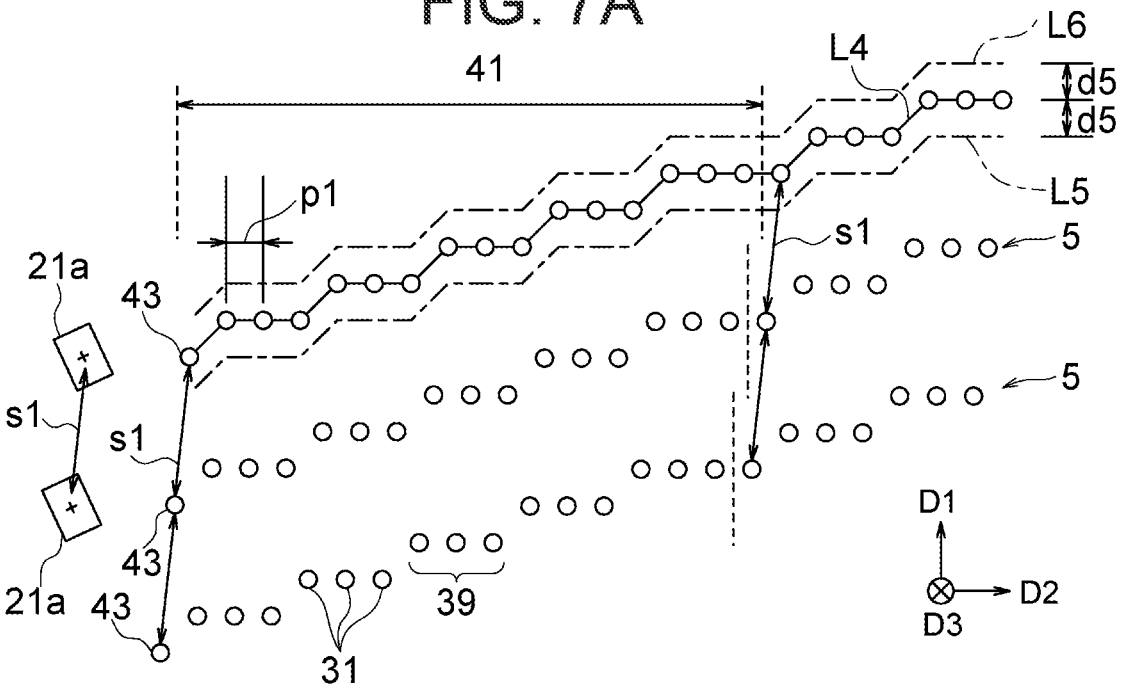
FIG. 7A is a schematic diagram for explaining the detail of the positional relationship of plural nozzle rows according to the embodiment.

FIG. 7A is a diagram for explaining the relationship between plural nozzle rows 5 in terms of the positions of nozzles 3. Specifically, FIG. 7A schematically illustrates nozzles 3 of three nozzle rows 5 in a similar manner to FIG.

6. FIG. 7A illustrates only three nozzle rows 5 for convenience, but the following description also applies to the other nozzle rows 5.

The relative positions of the plural nozzles 3 in each nozzle row 5 are identical across the plural nozzle rows 5, for example. Specifically, for example, the plural nozzle rows 5 include the same number of nozzle sets 41 of the same configuration (pattern), and the choices (the ratio and order) of the positions of the plural reference points 43 between the aforementioned two options are identical across the plural nozzle rows 5.

Figure 7B:
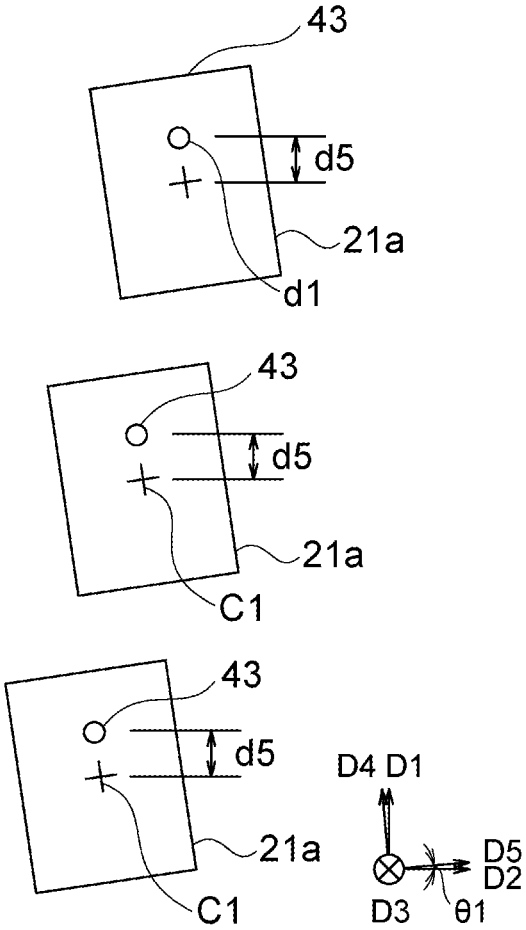
FIG. 7B is a transparent plan diagram illustrating relative positions of some of the nozzles illustrated in FIG. 7A to the respective partial channels.

FIG. 7B is a diagram illustrating the position in the bottom surfaces 21*a* of the partial channels 21 at the first reference points 43 (the reference points 43 farthest in the −D direction) concerning the three nozzle rows 5 in FIG. 7A.

As illustrated in FIG. 7B, the nozzles 3 at the first reference points 43 in the plural nozzle row 5 have openings at identical positions in the bottom surfaces 21*a*, for example. From another viewpoint, as illustrated in FIG. 7A, in the plural nozzle rows 5, the relative positions (see distance s1) of the first bottom surfaces 21*a* (illustrated away from the nozzles 3 for convenience) are identical to the relative positions (see distance s1) of the first reference points 43.

In the example of FIG. 7B, the first reference points 43 are shifted from centers C1 of the bottom surfaces 21*a* in the +D1 direction by a displacement d5. The positions of the first reference points 43 are not limited to those in FIG. 7B. The first reference points 43 may be positioned at the respective centers C1 or may be positioned on the −D1 sides of the respective centers C1. The displacement d5 may be identical to or different from the displacement d4 (FIG. 6) between each of the second and subsequent reference points 43 and the previous nozzle 3 or the like.

Herein, the relative positions of the plural nozzles 3 in each nozzle row 5 are identical across the plural nozzle rows 5 as described above. The relative relationship between the plural nozzles 3 in each nozzle row 5 is therefore identical across the plural nozzle rows 5, in terms of the position of openings of the nozzles 3 in the bottom surfaces 21*a*.

While the relative positions of the plural nozzles 3 in each nozzle row 5 are identical across the plural nozzle rows 5, the relative relationship between the plural nozzles 3 in each nozzle row 5 may be different across the plural nozzle rows 5 in terms of the position of openings in the bottom surfaces 21*a*.

Figure 7C:
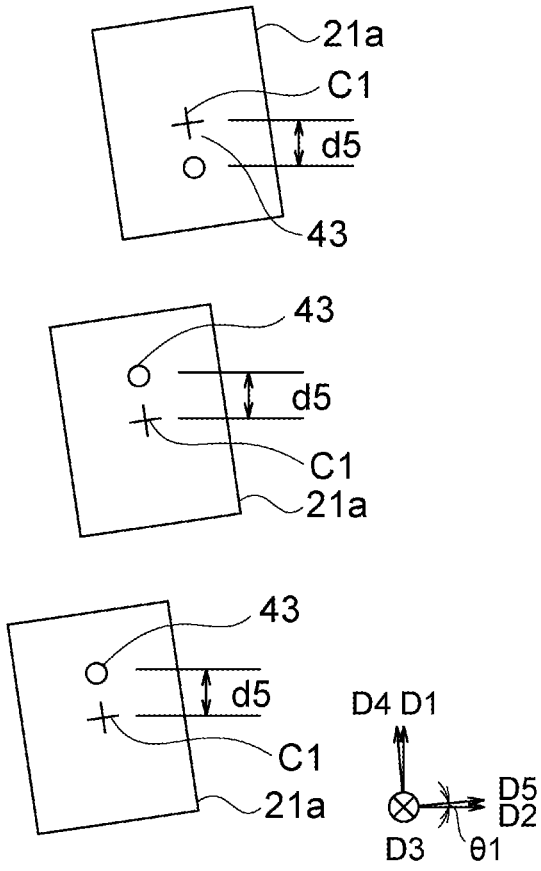
FIG. 7C is a diagram illustrating a modification in a similar manner to FIG. 7B.

For example, the positions of the first reference points 43 relative to the respective first bottom surfaces 21*a* may be selected from plural options predetermined. In FIG. 7A, for the nozzle row 5 at the top of the diagram, three options for the positions are illustrated by lines L4, L5, and L6. In the case illustrated in FIG. 7C, the first reference point 43 of the nozzle row 5 at the top of the diagram is shifted in the −D1 direction by the displacement d5 unlike the first reference points 43 of the other two nozzle rows 5. The positions of the first reference points 43 to the respective first bottom surfaces 21*a* may be properly (arbitrarily) determined for individual nozzle rows 5 (not illustrated).

Furthermore, the relative positions of the plural nozzles 3 in each nozzle row 5 may be substantially identical across the plural nozzle rows 5 while the positions of the first nozzles 3 in the respective nozzle rows 5 are sequentially shifted by different distances.

For example, when the first nozzle row 5 includes 600 nozzles 3 from nozzle #1 to nozzle #600, the second nozzle row 5 next to the first nozzle row 5, is configured to include 600 nozzles 3 from nozzle #2 to nozzle #601, and the relative positional relationship of the nozzles #2 to #600 in the second nozzle row 5 is designed to be identical to that of the nozzles #2 to #600 in the first nozzle row. The third nozzle row 5 next to the second nozzle row 5, is configured to include 600 nozzles 3 from the nozzle #3 to nozzle #602. The relative positional relationship of the nozzles #3 to #601 in the third nozzle row 5 is designed to be identical to that of the nozzles #3 to #601 in the second nozzle row 5. Such a configuration further improves the effect of reducing dark or light spots appearing regularly without individually designing the arrangement of the plural nozzles 3 in each nozzle row 5.

As described above, each head 2 includes the ejection surface 2*a*, the plural nozzles 3, and the plural partial channels 21. The ejection surface 2*a* extends in the first direction (in the D1 direction) as the scanning direction and in the second direction (in the D2 direction) orthogonal to the D1 direction and is exposed to the outside. The plural nozzles 3 open at the ejection surface 2*a*. The plural partial channels 21 are located on the inner side relative to the ejection surface 2*a*, and at the bottom surfaces 21*a* thereof disposed on the ejection surface 2*a* side, the nozzles 3 open. "Being located relative to the inner side of the ejection surface 2*a*" means "being located on the inner side of the ejection surface 2*a*", that is, "being located inside the head 2". The plural partial channels 21 communicate with the outside via the respective nozzles 3. The plural nozzles 3 are arranged in plural rows extending in the direction (substantially in the D5 direction) intersecting with the D1 direction to constitute the plural nozzle rows 5. Herein, the number of nozzles 3 arranged in each nozzle row 5 is greater than the number of the plural nozzle rows 5. Between the nozzles 3 in each nozzle row 5, the nozzles 3 of the other nozzle rows 5 appear as seen in the D1 direction. In each nozzle row 5, at least some of the nozzles 3 open at different positions in the bottom surfaces 21*a* of the partial channels 21.

This can lower the visibility of dark or light spots and apparently improve the image quality, for example. Specifically, this is because the following reasons.

In the head 2, processing errors are sometimes produced equally in each nozzle row 5. For example, consideration is given to a case where all the nozzles 3 are designed to open at identical positions in the respective bottom surfaces 21*a* of the partial channels 21. In this case, differences between actual positions of the openings of the nozzles 3 and the respective designed positions are identical across the plural nozzles 3 in each nozzle row 5 (in terms of the direction and magnitude thereof, for example) while the differences are varied across the nozzle rows 5 (the differences are varied in terms of at least one of the direction and magnitude, for example).

Herein, the position of the openings of the nozzles 3 in the bottom surfaces 21*a* exerts a comparatively large influence on the amounts of liquid ejected from the nozzles 3. For example, in general, nozzles 3 located farther from the centers of the respective bottom surface 21*a* eject less liquid. Due to processing errors produced equally in each nozzle row 5, the amounts of liquid ejected from the plural nozzles 3 in any one of the plural nozzle rows 5 are sometimes uniformly smaller or larger than those from the plural nozzles 3 in the other nozzle rows 5.

For example, it is assumed that in FIG. 3, processing errors of the position of the openings of the nozzles 3 in the nozzle row 5C are different from those of the other nozzle rows 5, and the amounts of ink ejected from the nozzle row 5C are smaller than those ejected from the other nozzle rows 5. In this case, as understood from black circles as projection of the nozzles 3 of the nozzle row 5C on the line L1, lighter (smaller) dots than the original dots according to image data are formed on a recording medium. These dots appear regularly on the line L1 (on the recording medium P). In FIG. 3, the black circles are illustrated on the line L1 in one-dimensional form. However, relative movement between the recording medium and the head 2 in the D1 direction produces light stripes extending in the D1 direction, at regular intervals in the D2 direction. This creates regular dark or light spots. Such regular dark or light spots are visible clearly.

In this embodiment, however, the nozzles 3 in each nozzle row 5 open at different positions in the respective bottom surfaces 21*a*. Even if processing errors are produced equally in each nozzle row 5, for example, the processing errors do not always have the same influence on the amounts of liquid ejected from the plural nozzles 3 in each nozzle row 5. As for the plural nozzles 3 illustrated in FIG. 5B, for example, it is assumed that the plural nozzles 3 are all shifted equally in the +D1 direction from the designed positions within the plural bottom surfaces 21*a*. In this case, one of the nozzles 3 is shifted away from the center of the bottom surface 21*a* and ejects less liquid. Another nozzle 3 is shifted close to the center of the bottom surface 21*a* and ejects more liquid.

The aforementioned configuration reduces the regularity in the D2 direction, of stripes that are lighter or darker than the color according to the image and extend in the D1 direction, for example. Furthermore, the configuration of the embodiment increases the distance in the D2 direction, between the stripes that are equally lighter or darker than the color according to the image and extend in the D1 direction, for example. This lowers the visibility of lighter or darker stripes like those described above and apparently improves the image quality.

In this embodiment, the nozzles 3 of each of the plural nozzle rows 5 are arranged in turn in the D2 direction in a predetermined order assigned to the respective nozzle rows 5 as seen in the D1 direction.

This keeps large spacing between the nozzles 3 adjacent to each other in each nozzle row while reducing the spacing between the adjacent nozzles 3 in the D2 direction as seen in the D1 direction.

In this embodiment, in the nozzles 3 opening at different positions in the bottom surfaces 21*a*, the openings are located at different positions in the bottom surfaces 21*a* at least in the D1 direction.

For example, compared with a mode in which the nozzles 3 in each nozzle row 5 open at different positions in the bottom surfaces 21*a* only in the D2 direction (this mode is also included in the technique according to the disclosure), therefore, it is possible to reduce variation in pitch of the plural nozzles 3 in each nozzle row 5. The embodiment provides the effect of lowering the visibility of the aforementioned dark or light spots as well as maintaining the image quality by keeping constant the pitch of printed dots in the D2 direction.

In the embodiment, the bottom surfaces 21*a* of the plural partial channels 21 constitute the plural bottom surface rows 22 located above the respective plural nozzle rows 5. The bottom surfaces 21*a* of each bottom surface row 22 are arranged linearly with a consistent pitch in the third direction (in the D5 direction) that intersects with the D1 direction.

The variation in position of the openings of the plural nozzles 3 in the bottom surfaces 21*a* is implemented by the configuration in which the nozzles 3 are not linearly arranged and/or the nozzles 3 are not arranged with a consistent pitch. For example, compared with a mode in which the nozzles 3 are arranged linearly with a consistent pitch while the bottom surfaces 21*a* are not linearly arranged and/or the nozzles 3 are not arranged with a consistent pitch (this mode is also included in the technique according to the disclosure), the heads 2 are easily designed and miniaturized. This is because the nozzles 3 are smaller than the bottom surfaces 21*a* and conventional heads include enough room to change positions of the nozzles 3 compared with the room to change positions of the bottom surfaces 21*a*, for example. In addition, the nozzles 3 are formed in the single nozzle plate 27A. Changing the positions of the nozzles 3 is implemented only by modifying the nozzle plate 27A while changing the positions of the bottom surfaces 21*a* (changing the shape of the partial channel 21) cannot always be conducted only by modifying the one substrate 27 (27B).

In this embodiment, at least some of the plural nozzles 3 in each nozzle row 5 are arranged in a meandering manner in the third direction (in the D5 direction).

The aforementioned configuration allows the nozzles 3 shifted away from the centers of the respective bottom surfaces 21*a* due to processing errors and the nozzles 3 shifted close to the centers of the respective bottom surfaces 21*a* due to processing errors to be arranged alternately to some extent, for example. This ensures to reduce the regularity of dark or light spots, for example.

In this embodiment, the D5 direction in which the bottom surfaces 21*a* of the partial channels 21 are arranged is inclined with respect to the D2 direction so that bottom surfaces 21*a* located farther in one direction along the D2 axis (in the +D2 direction) is also located farther in one direction along the D1 axis (in the +D1 direction). In each nozzle row 5, the meandering arrangement in the D5 direction is the staircase-like arrangement in which the plural nozzle groups 39 each include two or more nozzles 3 arranged in parallel to the D2 direction and each nozzle group 39 located farther in the +D2 direction is also located farther in the +D1 direction.

For example, the inclination of the bottom surface rows 22 to the D2 direction increases the density of the bottom surfaces 21*a* in the D2 direction, thus facilitating high-definition printing. Furthermore, the staircase-like arrangement of the nozzles 3 allows the nozzle groups 39 to intersect with the inclined bottom surface rows 22, so that the consecutive nozzles 3 in each nozzle group 39 open at the different positions in the bottom surfaces 21*a*. The position of openings of the nozzles 3 in the bottom surfaces 21*a* therefore varies in short cycle. This further lowers the visibility of dark or light spots, for example. In addition, for example, the positions of all the nozzles 3 in the D1 direction do not need to be shifted one by one, so that the staircase-like arrangement is designed easily.

In the embodiment, at least one of the plural nozzle rows 5 includes plural nozzle sets 41 each including a predetermined number of nozzles 3. The relative positions of the plural nozzles 3 in each nozzle set 41 are identical across the plural nozzle sets 41.

It is therefore unnecessary to individually determine the positions in the D1 direction, of all the nozzles 3 in each nozzle row 5, facilitating the designing. The nozzle rows 5 are designed only by repeating the arrangement of the nozzles 3 within the nozzle sets 41. This significantly reduces the design burden.

In the embodiment, three or more nozzle sets 41 are consecutively disposed, and at least some of the relative positions of pairs of consecutive nozzle sets 41 in the three or more nozzle sets 41 are different from each other. From another viewpoint, in the embodiment, the position of each reference point 43 relative to the previous nozzle set 41 is selected from two options, for example.

For example, compared with a case where the nozzle sets 41 are repeatedly arranged with the relative position therebetween being consistent, therefore, the irregularity of the position of openings of the nozzles 3 in the bottom surfaces 21*a* is increased. This further reduces the regularity of dark or light spots and lowers the visibility thereof.

In this embodiment, the relative positions of the plural nozzles 3 in each nozzle row 5 are identical across the plural nozzle rows 5.

It is therefore unnecessary to design the positions of the nozzles 3 for each nozzle row 5, facilitating the designing.

In this embodiment, the bottom surfaces 21*a* of the partial channels 21 have a rectangular shape. The position of openings of the nozzles 3 in the bottom surfaces 21*a* differs across the individual channels 17. The openings are located at different positions in the bottom surfaces 21*a* at least in the direction of a diagonal of the rectangular shape.

For example, compared with a mode in which the bottom surfaces 21*a* are circular (the mode is also included in the technique according to the disclosure), it is possible to increase the variation in position of the nozzles 3 while minimizing the pitch of the plural bottom surfaces 21*a*.

In this embodiment, in each nozzle row 5, the position of openings of the nozzles 3 in the bottom surfaces 21*a* repeatedly undergoes a shift with respect to positions in the D2 direction. The interval between the shifts in the D2 direction is not more than 400 μm.

As for the regular dark or light spots, the shorter the regular intervals, the lower the visibility. As described above, any nozzles 3 opening at identical positions in the bottom surfaces 21*a* are not included within a range of 400 μm. This lowers the visibility of dark or light spots and apparently improves the image quality.

(Modification Related to Channel)

FIGS. 8A to 8F are schematic diagrams for explaining various modifications (including the modifications described above).

In this embodiment, the plural nozzles 3 are arranged with the consistent pitch p1 in the D2 direction and open at different positions in the bottom surfaces 21*a* of the partial channels 21 in the D1 direction. However, the openings of the plural nozzles 3 may be located at different positions in the bottom surfaces 21*a* in the D4 direction as indicated by arrows in FIG. 8A. The openings of the plural nozzles 3 may be located at different positions in the bottom surfaces 21*a* in the D2 direction as indicated by arrows in FIG. 8B. The openings of the plural nozzles 3 may be located at different positions in the bottom surfaces 21*a* in the D5 direction as indicated by arrows in FIG. 8C. In addition, the position of openings of the plural nozzles 3 may be varied on a combination of components in two directions.

In this embodiment, the bottom surfaces 21*a* are arranged linearly with a consistent pitch. However, as indicated by arrows in FIG. 8D, the variation in position of the openings of the plural nozzles 3 in the bottom surfaces 21*a* may be implemented when the bottom surfaces 21*a* are not arranged linearly and/or the bottom surfaces 21*a* are not arranged with a consistent pitch instead of or in addition to the nozzles 3.

In the mode described in the embodiment, the arrangement of the nozzles 3 relative to the ejection surface 2*a* includes repeated predetermined patterns (nozzle sets 41). As understood from FIG. 8D, the arrangement of the bottom surfaces 21*a* relative to the ejection surface 2*a* includes repeated predetermined patterns. Alternatively, the positions of the nozzles 3 relative to the bottom surfaces 21*a* may include repeated predetermined patterns together with or without predetermined patterns of nozzles 3 and/or bottom surfaces 21*a* relative to the ejection surface 2*a* being repeated.

Figure 8A:
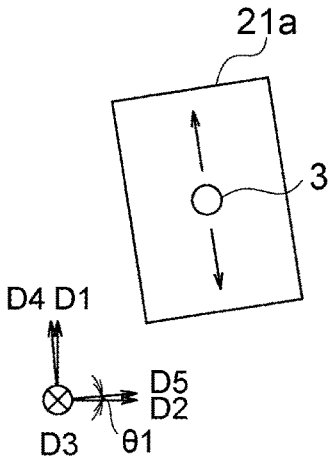
FIGS. 8A, 8B, 8C, 8D, 8E, and 8F are schematic diagrams for explaining various modifications concerning channels.
Figure 8B:
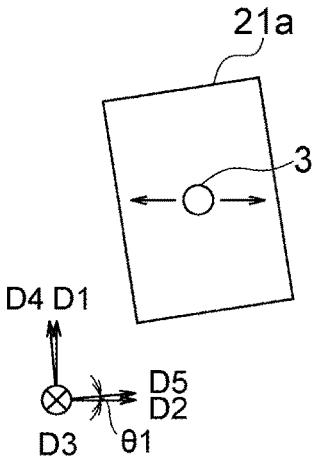
Figure 8C:
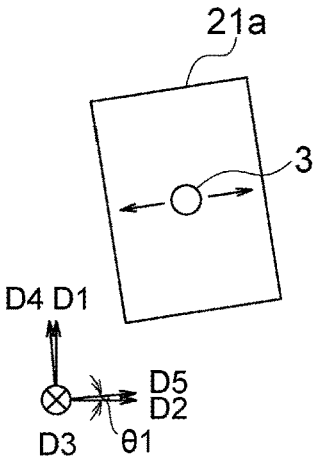
Figure 8D:
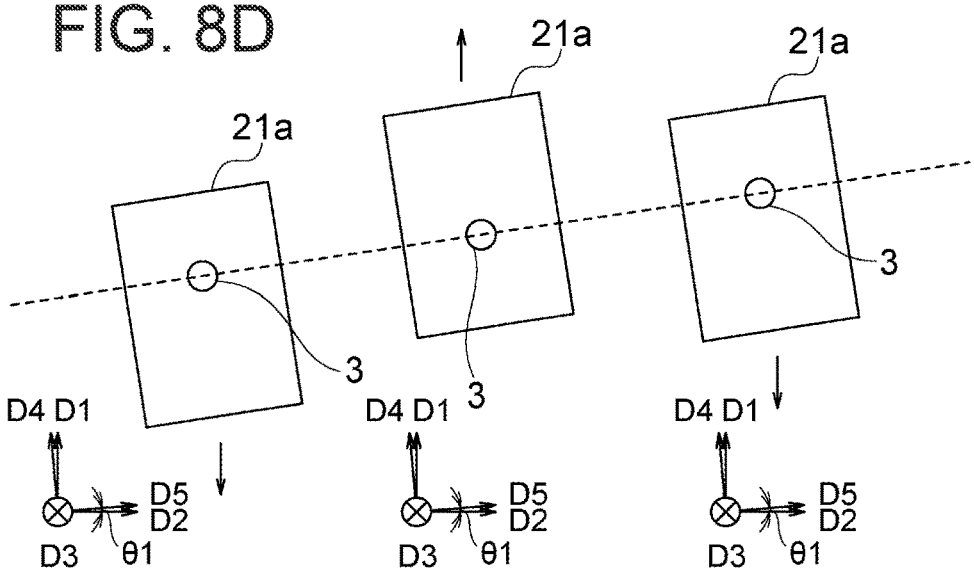
Figure 8E:
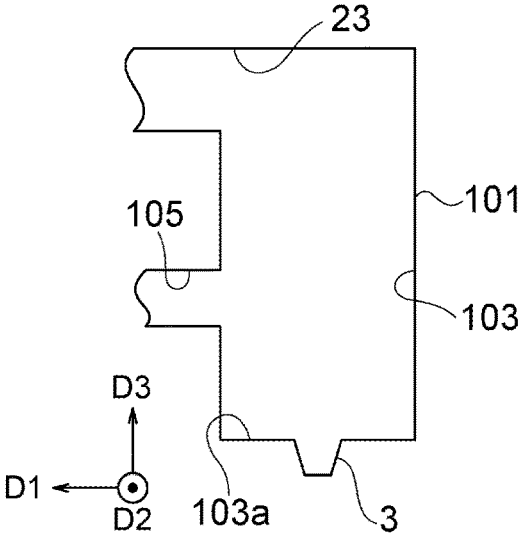
Figure 8F:
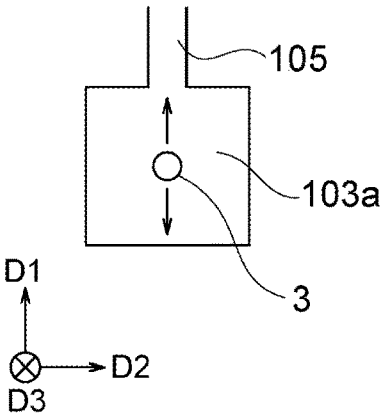

FIG. 8E is a schematic sectional view illustrating an individual channel 101 (a partial channel 103) according to a modification. FIG. 8F is a transparent plan view schematically illustrating a bottom surface 103*a* of the partial channel 103.

The individual channel 101 sometimes includes a connection channel 105 that opens at the wall surface surrounding the bottom surface 103*a*. The connection channel 105 is used to refill the partial channel 103 with ink and/or collect ink from the partial channel 103. In the thus-configured partial channel 103, as indicated by arrows in FIG. 8F, the variation in position between openings of the nozzles 3 in the bottom surfaces 103*a* may include a component in the opening direction of the connection channel 105 (in D1 direction in the example of FIG. 8F). The opening direction refers to a direction that the centerline of the connection channel 105 near the partial channel 103 extends toward the partial channel 103, for example.

When the position of openings of the nozzles 3 in the bottom surfaces 103*a* differs at least in the opening direction of the connection channel 105 across at least some of the partial individual channels 101 like this modification, the density of dark or light spots can be improved, for example. Specifically, when the connection channel 105 is disposed, ink flows in the opening direction of the connection channel 105 or in the opposite direction thereto within the partial channel 103. From another viewpoint, ink flows in the middle of the partial channel 103 in the D2 direction while ink flows slowly in the both ends in the D2 direction. This reduces differences in amount of ink ejected from the plural nozzles 3 compared to the case where the position of openings of the nozzles 3 in the D2 direction differs across the individual channels 101.

(Modification Related to Recording Device)

Figure 9A:
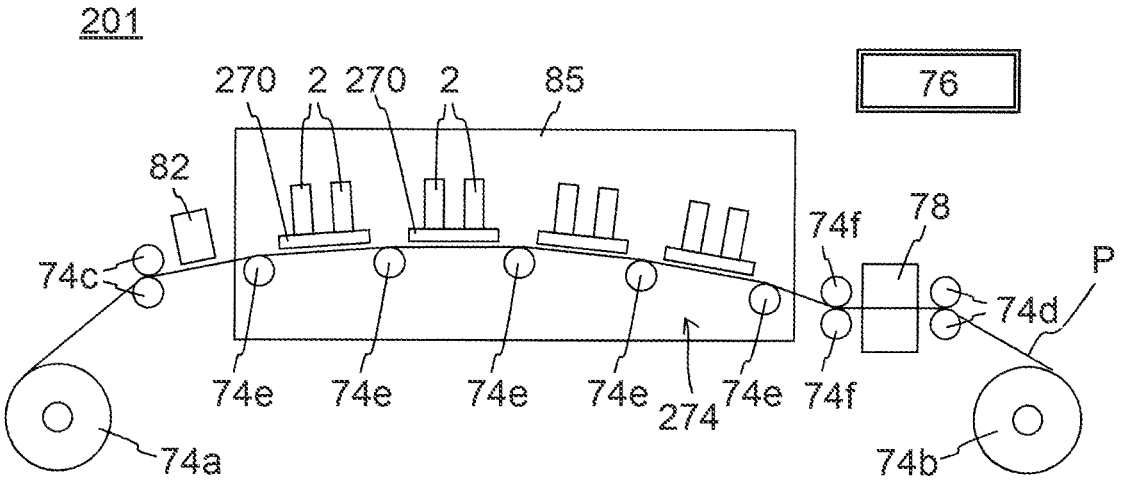
FIG. 9A is a side view illustrating a modification of the recording device.
Figure 9B:
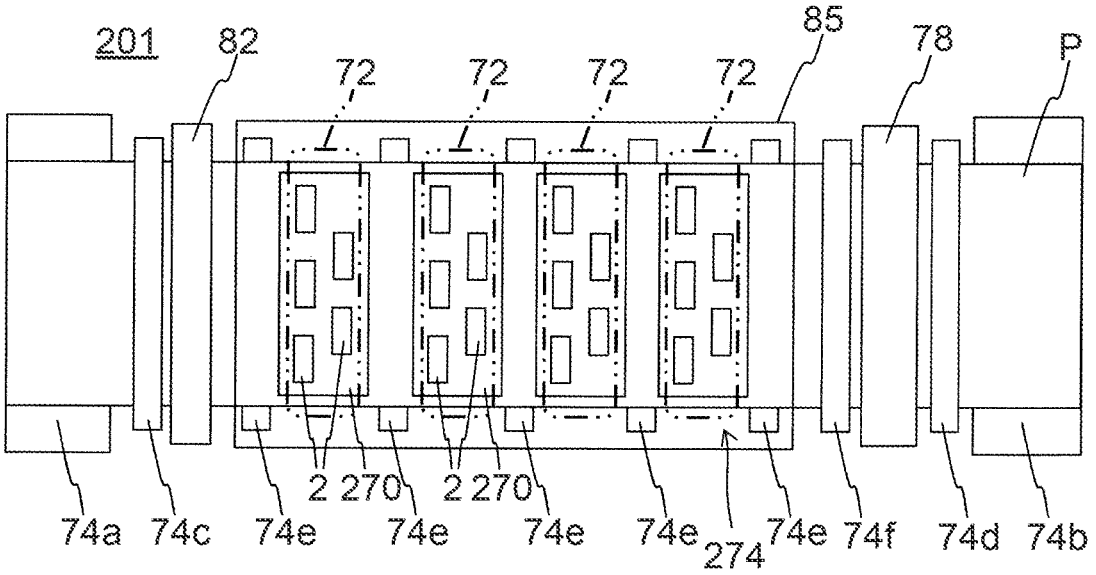
FIG. 9B is a plan view schematically illustrating the modification of the recording device.

FIG. 9A is a side view illustrating the configuration of main part of a printer 201 according to a modification. FIG. 9B is a top view of the printer 201. The following description is basically given to the differences from the printer 1 according to the embodiment. The printer 201 is the same as the printer 1 in the matters not described in particular. In the printer 1 illustrated in FIGS. 1A and 1B, the recording medium P moves from right to left on the page. FIGS. 9A and 9B illustrate the printer 1 in which the recording medium P moves left to right on the page, which is opposite to that in FIGS. 1A and 1B.

As already described in the embodiment, printing may be performed by ejecting a coating agent from the heads 2. The coating agent may be uniformly applied with a coater 82 controlled by the controller 76 like the modification, instead of ejecting the coating agent from the heads 2. The recording medium P fed from the conveyance roller 74*a* passes between the two conveyance rollers 74*c* of a driving section 274 and then passes under the coater 82. In this process, the coater 82 applies the coating agent to the recording medium P. The recording medium P is then conveyed under the heads 2.

The printer 201 according to the modification includes a head chamber 85 accommodating the heads 2. The head chamber 85 partially communicates with the outside in sections where the recording medium P enters or exits and the like but is a space substantially insulated from the outside. The control factors (at least one) in the head chamber 85, such as temperature, humidity, and atmospheric pressure, are optionally controlled by the controller 76 or the like. The inside of the head chamber 85 can be less influenced by external disturbances compared with the outside thereof, so that the ranges of fluctuation in the aforementioned control factors can be narrower than that on the outside.

Head-mounting frames 270 on which the heads 2 are mounted substantially correspond to divisions of the head-mounting frame 70 of the embodiment for the respective head groups 72. The head-mounting frames 270 are accommodated in the head chamber 85. In the head chamber 85, five guide rollers 74*e* are disposed, and the recording medium P is conveyed on the guide rollers 74*e*. The five guide rollers 74*e* are convex to the side where the head mounting frames 270 are mounted, in the middle thereof as seen in a side view. The recording medium P being conveyed on the five guide rollers 74*e* are therefore circular in a side view. When the recording medium P is subjected to a tension, the sections of the recording medium P between the guide rollers 74*e* are pulled to be flat. Between each pair of two adjacent guide rollers 74*e*, one of the head-mounting frames 270 is disposed. The head-mounting frames 270 are disposed at slightly different angles so as to be parallel to the recording medium P being conveyed under the head-mounting frames 270.

The printer 201 according to the modification includes a dryer 78. After exiting the head chamber 85, the recording medium P passes between the two conveyance rollers 74*f* and moves in the dryer 78. Drying the recording medium P with the dryer 78 makes it less likely that on the conveyance roller 74*b*, overlapping portions of the rewound recording medium P adhere to each other or undried liquid is smudged. For high-speed printing, it is also necessary to dry quickly. To dry quickly, the dryer 78 may dry the recording medium P by using plural drying methods sequentially or in parallel. The drying methods used in such a process include: exposure to hot air; infrared-ray irradiation; and contact with a heated roller, for example. In infrared-ray irradiation, the recording medium P may be irradiated with infrared rays of a specific range of frequency so as to be dried quickly with less damage on the recording medium P. In the process of bringing a heated roller into contact with the recording medium P, the recording medium P may be conveyed along the cylindrical surface of the roller to increase the time to transfer heat. The range of the cylindrical surface of the roller on which the recording medium P is conveyed is preferably not less than a quarter of the cylindrical surface of the roller and more preferably not less than a half of the cylindrical surface. In printing with UV-curable ink or the like, UV irradiation light sources may be disposed instead of or in addition to the dryer 78. The UV irradiation light sources may be disposed between the head-mounting frames 270.

At least one of the coater 82, the head chamber 85, and the dryer 78 may be combined with the head-mounting frame 70 of the embodiment.

The printer 1 or 201 may include a cleaning section that cleans the heads 2. The cleaning section performs wiping or cleaning with capping, for example. Wiping refers to rubbing surfaces of sections that eject liquid, or the ejection surface 2*a*, for example, with a flexible wiper, for example, to remove liquid sticking to the surfaces. Cleaning with capping is performed as follows, for example. First, sections ejecting liquid, or the ejection surface 2*a*, for example, are covered with a cap (referred to as capping) so that the ejection surface 2*a* and cap form a space nearly sealed. Liquid is then repeatedly ejected to remove liquid that is stuck in the nozzles 3 and is more viscous than the normal state, foreign substances, and the like. Capping prevents scatter of the liquid onto the printer 1 or 201 during cleaning, making it less likely for the liquid to adhere to the recording medium P or the conveying mechanism including the rollers. The ejection surface 2*a* already cleaned may be further subjected to wiping. Wiping and cleaning with capping may be performed by a person manually operating the wiper or the cap attached to the printer 1 or 201 or may be performed automatically by the controller 76.

The techniques according to the disclosure are not limited to the aforementioned embodiment and modifications and may be implemented in various modes.

For example, the head (printer) is not limited to line-type and may be serial-type. Specifically, in FIGS. 2A and 2B, for example, the head 2 may be moved in the D1 direction (in the main scanning direction) to form a belt-shaped two-dimensional image. The aforementioned formation of the belt-shaped two-dimensional image and paper feed in the D2 direction (in the sub-scanning direction) may be alternated to form a two-dimensional image including the belt-shaped two-dimensional images connected in the D2 direction.

The heads are not limited to the piezo-electric heads that apply pressure to the individual channels with the piezo-electric elements. The heads may be thermal-type heads that apply pressure to the individual channels by generating bubbles in the liquid through a heating element, for example.

The nozzle rows (bottom surface rows) unnecessarily are inclined with respect to the second direction, which is orthogonal to the first direction as the scanning direction. In other words, the nozzle rows may be substantially parallel to the second direction. In this case, for example, the bottom surfaces of the plural partial channels may be linearly arranged in parallel to the second direction while the plural nozzles are arranged in a meandering manner in the second direction. Rotating the example illustrated in in FIGS. 5A and 5B to align the D1 and D2 axes with the D4 and D5 axes, respectively, results in an example of this mode, which is not illustrated.

The staircase-like or zigzag arrangement may appear in only a part of each nozzle row or appear throughout each nozzle row. The plural nozzles may be arranged in a manner other than the staircase-like or meandering manner. The plural nozzles unnecessarily include plural repeated nozzle sets.

The position of openings of the nozzles in the respective bottom surfaces of the partial channels may be irregularly set for all the plural nozzles in each nozzle row or for all the plural nozzles in each nozzle set. As for the irregularity, the nozzles unnecessarily are arranged in a strictly irregular manner and only needs to be arranged in an irregular manner typically recognized. For example, the position of openings of nozzles may be calculated by assigning irregular values to the plural nozzles by using a random number table and subtracting the values into a proper function.

The effect of lowering the visibility of dark or light spots is presented concerning the techniques according to the disclosure provide. However, the techniques according to the disclosure unnecessarily provide this effect.

REFERENCE SIGNS LIST

1 PRINTER (RECORDING DEVICE)
2 LIQUID EJECTING HEAD
2*a* EJECTION SURFACE

3 NOZZLE
5 NOZZLE ROW
13 CHANNEL MEMBER
17 INDIVIDUAL CHANNEL
21 PARTIAL CHANNEL
21*a* BOTTOM SURFACE
37 PRESSURIZATION ELEMENT

The invention claimed is:

1. A liquid ejecting head, comprising:
an ejection surface which extends in a first direction as a scanning direction and a second direction orthogonal to the first direction, and is externally exposed;
a common channel;
a plurality of individual channels, each of the plurality of individual channels are in communication with the common channel;
a plurality of nozzles opening at the ejection surface;
a pressurization element which applies pressure to a plurality of pressure chambers, and is located on a side opposite the ejection surface with respect to the plurality of pressure chambers; and
a plurality of partial channels located inside the ejection surface and comprising bottom surfaces on a side of the ejection surface, respective nozzles of the plurality of nozzles opening at the bottom surfaces, wherein
nozzles of the plurality of nozzles are arranged in plural rows in a direction intersecting with the first direction to constitute a plurality of nozzle rows,
a number of the nozzles arranged in each nozzle row of the plurality of nozzle rows is greater than a number of the plural rows,
between nozzles in each nozzle row of the plurality of nozzle rows are nozzles in other nozzle rows of the plurality of nozzle rows as viewed in the first direction,
a position of openings in the bottom surfaces of the plurality of partial channels differs across at least some nozzles of the plurality of nozzles in the each nozzle row,
each of the plurality of individual channels includes one of the plurality of pressure chambers and a supply path,
the supply path connects the common channel and one of the plurality of pressure chambers, and
one of the plurality of partial channels connects one of the plurality of pressure chambers and one of the plurality of nozzles.

2. The liquid ejecting head according to claim 1, wherein as viewed in the first direction, the nozzles in the each nozzle row are arranged in a predetermined order assigned to the plurality of nozzle rows.

3. The liquid ejecting head according to claim 1, wherein the position of the openings in the bottom surfaces differs across the at least some of the nozzles at least in the first direction.

4. The liquid ejecting head according to claim 3, wherein a density of the nozzles, as viewed in the first direction, is a product of a density of the nozzles in the each nozzle row and a number of the plurality of nozzle rows.

5. The liquid ejecting head according to claim 1, wherein
the bottom surfaces of the plurality of partial channels constitute a plurality of bottom surface rows located above the plurality of nozzle rows, and
bottom surfaces of each bottom surface row of the plurality of bottom surface rows are arranged with a consistent pitch linearly in a third direction intersecting with the first direction.

6. The liquid ejecting head according to claim 5, wherein at least a part of an arrangement of the plurality of nozzles is a meandering arrangement in the third direction in the each nozzle row.

7. The liquid ejecting head according to claim 6, wherein
the third direction inclines with respect to the second direction, and is located farther in one direction along the second direction, and also is located in one direction along the first direction, and
the part of the arrangement is a staircase-like arrangement which comprises a plurality of nozzle groups, each nozzle group of the plurality of nozzle groups comprising two or more nozzles arranged in parallel to the second direction in the each nozzle row, and
nozzle groups, of the plurality of nozzle groups, located farther in the second direction are also located farther in the first direction.

8. The liquid ejecting head according to claim 5, wherein
at least one nozzle row of the plurality of nozzle rows comprises a plurality of nozzle sets each comprising a predetermined number of the nozzles, and
relative positions of the plurality of nozzles in the each of the plurality of nozzle sets are identical across the plurality of nozzle sets.

9. The liquid ejecting head according to claim 8, wherein the plurality of nozzle sets comprise at least three nozzle sets consecutively disposed, and at least some of relative positions of consecutive two nozzle sets among the at least three nozzle sets are different from each other.

10. The liquid ejecting head according to claim 5, wherein relative positions of the plurality of nozzles in the each nozzle row of the plurality of nozzle rows are identical across the plurality of nozzle rows.

11. The liquid ejecting head according to claim 1, wherein
each bottom surface of the bottom surfaces of the plurality of partial channels has a rectangular shape, and
the position of the openings in the bottom surfaces differs across the at least some of the nozzles at least in a direction of a diagonal of the rectangular shape.

12. The liquid ejecting head according to claim 1, further comprising a connection channel opening at a wall surface surrounding each of the bottom surfaces of the plurality of partial channels, wherein
the position of the openings in the bottom surfaces differs across the at least some of the nozzles at least in an opening direction of the connection channel.

13. The liquid ejecting head according claim 1, wherein
the position of the openings of the plurality of nozzles in the bottom surfaces is repeatedly subjected to a shift with respect to positions in the second direction in the each nozzle row, and an interval between shifts in the second direction is equal to or smaller than 400 μm.

14. A recording device, comprising:
the liquid ejecting head according to claim 1; and
a driving section causing relative movement in the first direction between the liquid ejecting head and a recording medium.

15. A recording device, comprising:
the liquid ejecting head according to claim 1;
a head chamber accommodating the liquid ejecting head; and
a controller, wherein
the controller controls at least one of temperature, humidity, and atmospheric pressure in the head chamber.

16. A recording device, comprising:
the liquid ejecting head according to claim 1; and
a coater applying a coating agent to a recording medium.

17. A recording device, comprising:

the liquid ejecting head according to claim 1; and a dryer drying a recording medium.

18. A liquid ejecting head, comprising:

an ejection surface which extends in a first direction as a scanning direction and a second direction orthogonal to the first direction, and is externally exposed;

a common channel;

a plurality of individual channels, each of the plurality of individual channels are in communication with the common channel;

a plurality of nozzles opening at the ejection surface; and a plurality of partial channels located inside the ejection surface and comprising bottom surfaces on a side of the ejection surface, respective nozzles of the plurality of nozzles opening at the bottom surfaces, wherein nozzles of the plurality of nozzles are arranged in plural rows in a direction intersecting with the first direction to constitute a plurality of nozzle rows, a number of the nozzles arranged in each nozzle row of the plurality of nozzle rows is greater than a number of the plural rows, between nozzles in each nozzle row of the plurality of nozzle rows are nozzles in other nozzle rows of the plurality of nozzle rows as viewed in the first direction, a position of openings in the bottom surfaces of the plurality of partial channels differs across at least some nozzles of the plurality of nozzles in the each nozzle row, each of the plurality of individual channels includes a pressure chamber and a supply path, the supply path connects the common channel and the pressure chamber, one of the plurality of partial channels connects the pressure chamber and one of the plurality of nozzles, and the each nozzle row includes two or more nozzles which are adjacent to each other and are located on the same positions in the first direction.

19. The liquid ejecting head according to claim 18, wherein the bottom surfaces of the plurality of partial channels constitute a plurality of bottom surface rows located above the plurality of nozzle rows, bottom surfaces of each bottom surface row of the plurality of bottom surface rows are arranged with a consistent pitch linearly in a third direction intersecting with the first direction, at least a part of an arrangement of the plurality of nozzles is a meandering arrangement in the third direction in the each nozzle row, the third direction inclines with respect to the second direction, and is located farther in one direction along the second direction, and also is located in one direction along the first direction, and the part of the arrangement is a staircase-like arrangement which comprises a plurality of nozzle groups, each nozzle group of the plurality of nozzle groups comprising the two or more nozzles arranged in parallel to the second direction in the each nozzle row, and nozzle groups, of the plurality of nozzle groups, located farther in the second direction are also located farther in the first direction.

20. A liquid ejecting head, comprising:

an ejection surface which extends in a first direction as a scanning direction and a second direction orthogonal to the first direction, and is externally exposed;

a common channel;

a plurality of individual channels, each of the plurality of individual channels are in communication with the common channel;

a plurality of nozzles opening at the ejection surface; and a plurality of partial channels located inside the ejection surface and comprising bottom surfaces on a side of the ejection surface, respective nozzles of the plurality of nozzles opening at the bottom surfaces, wherein nozzles of the plurality of nozzles are arranged in plural rows in a direction intersecting with the first direction to constitute a plurality of nozzle rows, a number of the nozzles arranged in each nozzle row of the plurality of nozzle rows is greater than a number of the plural rows, between nozzles in each nozzle row are nozzles in other nozzle rows of the plurality of nozzle rows as viewed in the first direction, a position of openings in the bottom surfaces of the plurality of partial channels differs across at least some nozzles of the plurality of nozzles in the each nozzle row, each of the plurality of individual channels includes a pressure chamber and a supply path, the supply path connects the common channel and the pressure chamber, one of the plurality of partial channels connects the pressure chamber and one of the plurality of nozzles, the each nozzle row includes a plurality of nozzle sets and each of the plurality of nozzle sets includes a plurality of nozzle groups each containing a plurality of nozzles, the plurality of nozzle groups are configured in a staircase-like arrangement, and each of the plurality of nozzle sets includes a first nozzle which is not in any of the nozzle groups.

* * * * *